US007631600B2

(12) United States Patent
O'Dwyer

(10) Patent No.: US 7,631,600 B2
(45) **Date of Patent: *Dec. 15, 2009**

(54) TARGET INTERCEPTION

(75) Inventor: Sean Patrick O'Dwyer, Brisbane (AU)

(73) Assignee: Metal Storm Limited, Brisbane (AU)

( * ) Notice: Subject to any disclaimer, the term of this patent is extended or adjusted under 35 U.S.C. 154(b) by 554 days.

This patent is subject to a terminal disclaimer.

(21) Appl. No.: 10/524,743

(22) PCT Filed: Aug. 15, 2003

(86) PCT No.: PCT/AU03/01034

§ 371 (c)(1),
(2), (4) Date: Aug. 29, 2005

(87) PCT Pub. No.: WO2004/017014

PCT Pub. Date: Feb. 26, 2004

(65) Prior Publication Data

US 2006/0130695 A1 Jun. 22, 2006

(30) Foreign Application Priority Data

Aug. 16, 2002 (AU) ..... 2002950846

(51) Int. Cl.
*F42B 12/58* (2006.01)
*F41F 1/00* (2006.01)

(52) U.S. Cl. ..... 102/438; 102/480

(58) Field of Classification Search ..... 102/340, 102/342, 351, 357, 374, 393, 405, 474, 480, 102/489, 491–497, 505, 703, 438; 89/1.11
See application file for complete search history.

(56) References Cited

U.S. PATENT DOCUMENTS

| | | | |
|---|---|---|---|
| 34,302 | A | 2/1862 | Jones |
| 34,685 | A | 3/1862 | Hathaway |
| 1,275,660 | A | 8/1918 | Clark |
| 1,284,777 | A | 11/1918 | Rinehart |
| 1,289,483 | A | 12/1918 | Leal |
| 1,300,333 | A | 4/1919 | Berry |

(Continued)

FOREIGN PATENT DOCUMENTS

DE 2500089 7/1976

(Continued)

OTHER PUBLICATIONS

Metal Storm Limited, International Search Report, PCT/AU2003/01034, Jan. 16, 2004, 7pp.

(Continued)

*Primary Examiner*—Bret Hayes
(74) *Attorney, Agent, or Firm*—Blakely Sokoloff Taylor & Zafman LLP

(57) ABSTRACT

A projectile deployment system for use in intercepting a target (32) wherein the system includes a body (10) defining a body axis, and a number of barrels (30) circumferentially spaced around the body axis. Each of the barrels (30) contains a number of projectiles (31) axially stacked therein, with a corresponding number of charges being provided such that each charge is associated with a respective projectile (31) along barrel (30). Each of the charges is individually activated to deploy a respective projectile (31) in response to a signal from a controller.

19 Claims, 26 Drawing Sheets

U.S. PATENT DOCUMENTS

| | | | | |
|---|---|---|---|---|
| 1,303,877 | A | 5/1919 | Francois | |
| 1,312,005 | A | 8/1919 | Sigler | |
| 1,343,036 | A | 6/1920 | Cook | |
| 2,264,906 | A | 12/1941 | Roby | |
| 2,359,192 | A | 9/1944 | Beblo | |
| 2,376,227 | A | 5/1945 | Brown | |
| 2,379,257 | A | 6/1945 | Scott | |
| 2,419,854 | A | 4/1947 | Peterson | |
| 2,925,965 | A | 2/1960 | Pierce | |
| 3,948,175 | A | 4/1976 | Bucklisch | |
| 4,036,140 | A | 7/1977 | Korr et al. | |
| 4,172,407 | A | 10/1979 | Wentink | |
| 4,210,082 | A | 7/1980 | Brothers | |
| 4,344,489 | A | 8/1982 | Bonaparte | |
| 4,372,216 | A | 2/1983 | Pinson et al. | |
| 4,444,117 | A | 4/1984 | Mitchell, Jr. | |
| 4,676,167 | A * | 6/1987 | Huber et al. | 102/393 |
| 4,938,146 | A | 7/1990 | Gunther et al. | |
| 4,957,046 | A | 9/1990 | Puttock | |
| 4,996,923 | A | 3/1991 | Theising | |
| 5,014,590 | A | 5/1991 | Moggert | |
| 5,067,411 | A | 11/1991 | Ball | |
| 5,191,169 | A | 3/1993 | Hu | |
| 5,222,996 | A | 6/1993 | Marshall et al. | |
| 5,301,614 | A | 4/1994 | Rieger | |
| 5,495,787 | A | 3/1996 | Boyer, III | |
| 5,497,704 | A | 3/1996 | Kurschner et al. | |
| 5,535,679 | A | 7/1996 | Craddock | |
| 5,577,431 | A | 11/1996 | Kusters | |
| 5,652,407 | A | 7/1997 | Carbone | |
| 5,796,031 | A | 8/1998 | Sigler | |
| 6,889,935 | B2 * | 5/2005 | O'Dwyer | 244/3.21 |
| 2003/0122032 | A1 * | 7/2003 | O'Dwyer | 244/3.1 |
| 2003/0172832 | A1 | 9/2003 | O'Dwyer | |

FOREIGN PATENT DOCUMENTS

| | | | |
|---|---|---|---|
| DE | 4209051 | | 9/1993 |
| EP | 0395520 | | 10/1990 |
| EP | 821215 | A | 1/1998 |
| GB | 2245051 | | 12/1991 |
| GB | 1430750 | A | 4/1996 |
| RU | 2149344 | | 5/2001 |
| WO | WO 97/04281 | | 2/1997 |
| WO | WO 97/16696 | A | 5/1997 |
| WO | WO 00/52414 | | 9/2000 |
| WO | WO 01/53770 | A | 7/2001 |
| WO | WO 03/006915 | A | 1/2003 |

OTHER PUBLICATIONS

Metal Storm Limited, International Preliminary Examination Report, PCT/AU2003/01034, Aug. 17, 2004, 8pp.

* cited by examiner

TARGET INTERCEPTION

CROSS-REFERENCES TO RELATED APPLICATIONS

The present patent application is a national phase application of International Application No. PCT/AU03/001034 filed Aug. 15, 2003, which claims priority from Australian Application No. 2002950846 filed Aug. 16, 2002.

BACKGROUND OF THE INVENTION

The present invention relates to a projectile deployment device for use in a target intercept device, and method for intercepting a target and in particular to projectiles deployment devices for use in kill vehicles and missile defence systems for intercepting missiles such as ballistic missiles.

DESCRIPTION OF THE PRIOR ART

The reference to any prior art in this specification is not, and should not be taken as, an acknowledgment or any form of suggestion that the prior art forms part of the common general knowledge.

There are a number of fundamental difficulties involved in the interception of an incoming enemy ballistic missile with a conventional interception missile or other similar kill vehicle. In particular, engineering a hit-to-kill interception missile that can achieve intercept with any consistency is problematic, principally because of the high converging speed of the target ballistic missile and the interception missile.

Thus the speed of both the incoming missile and the interception missile make tracking the incoming missile to within a hit-to-kill margin of error, extremely difficult. Present missile tracking technologies are quite sophisticated, however the problem remains that often quite significant changes in the trajectory of the interception missile are required but are difficult to execute.

This problem is exacerbated by the fact that typical conventional interception missiles have a relatively small cross-sectional diameter which must intercept either the front or side of the incoming enemy missile, which also has a very small cross-sectional area. Thus, this provides a small collision cross section, meaning it is difficult to achieve the required degree of control to enable the interception missile to be in exactly the right place at the right time to achieve a direct hit and thereby eliminate the target missile.

Accordingly, whilst a guaranteed hit is the ultimate goal, it is advantageous if an interception missile could be permitted to miss its target and yet still have an excellent chance of disabling the missile, through the use of secondary projectile impacts.

One known solution to this is to provide the interception missile with a fragmentation warhead, which is detonated before the projected impact. In this case, the fragmentation causes shrapnel to be spread away from the interception missile, thereby increasing the chance of a hit on the enemy missile. However, the majority of current fragmentation techniques utilise the detonation of an explosive charge, to project shrapnel away from the missile and do not provide a homogenous fragmentation pattern, but rather result in random and extremely haphazard shrapnel dispersion.

The fragmentation pattern of a simple detonation is depicted in FIG. 1, which shows a detonation occurring at 1, and which results in an expanding sphere 2 of shrapnel fragments 3. As shown in the expanded portion the shrapnel fragments 3 are distributed randomly and do not ensure a hit on an enemy missile 4, which can pass through the outwardly expanding radius of the sphere 2. This means that the fragmentation radius of a detonation cannot be relied upon to increase the allowable margin of error in interception time and position of the interception missile or kill vehicle. In this regard it should be noted that the diagrams presented in this specification are necessarily not to scale, and are provided merely by way of representation.

An additional problem with missile interception is that divert propulsion technologies are limited in their effect due to the size and weight of the interception missile, as well as its speed. The angle of interception of the missile can be changed by ejecting mass from the missile at an angle to the direction of travel. The capability of current divert propulsion systems is severely limited by the very small mass ejected in order to affect changes in trajectory.

Modern ballistic missiles, such as long range ICBMs (intercontinental ballistic missiles), can be designed to deploy multiple decoys and live warheads during flight. Accordingly, an interception missile for defeating this threat must employ a large range of sensory technology in order to select or discriminate the live warheads from the decoy warheads.

There is not believed to be any technology currently available to satisfactorily address this threat.

Accordingly, it will be appreciated that the ability of missiles to intercept targets including other target missiles is currently limited.

SUMMARY OF THE PRESENT INVENTION

In a first broad form the present invention provides a projectile deployment system for use in a target intercepting device, the projectile deployment system including:

a) A body defining a body axis;
b) A number of barrels circumferentially spaced around the body axis,
c) A number of projectiles axially stacked along each barrel;
d) A number of charges, each charge being associated with a respective projectile to urge the respective projectile along the barrel upon activation to thereby deploy the projectile.

Typically:

a) The body includes a support body defining the number of barrels, the barrels being adapted to receive the projectiles and associated charges at predetermined positions; and,
b) The body including a number of connectors extending therethrough for connecting first and second connections provided on each projectile to a controller.

The controller is preferably housed in a cavity in the support body.

The first and second connections of each projectile can be coupled to an ignition means for activating the charge associated with the respective projectile.

The connectors typically include:

a) A number of sets of first connectors, each set of first connectors coupling the first connections of each of the projectiles in a respective set of barrels to the controller; and,
b) A number of second connectors, each second connector coupling the second connections of selected projectiles in different sets of barrels to the controller, thereby allowing the controller to apply activation signals to selected ones of the sets of first connectors and the second connectors to thereby deploy selected projectiles.

The body can alternatively include a support member having a number of barrels mounted thereon.

In this case, typically:

a) Each projectile is associated with ignition means for activating the charge associated with the respective projectile;

b) Each barrel is provided with respective barrel connectors for connecting to the ignition means, the connectors extending along the barrel to a breach end; and, c) A number of connectors provided in the support member, the connectors being adapted to cooperate with the barrel connectors to thereby couple the ignition means to a controller.

The support member typically includes a cavity for receiving the controller.

The projectile deployment system can include a controller for deploying the projectiles by:

a) Activating the charge associated with the projectile positioned nearest to a muzzle end of one or more selected barrels;

b) Repeating step (a) to thereby fire the projectiles sequentially from the barrel.

The controller is preferably adapted to selectively activate the charges to thereby deploy the projectiles in accordance with a projectile deployment pattern.

The controller typically activates the charges by applying a predetermined activation pulse thereto. Typically the projectile deployment system includes one or more firing circuits for generating the activation pulses.

The controller can be adapted to fire the charges at predetermined time intervals to thereby control the rate of deployment of the projectiles.

The controller can include:

a) A store for storing pattern data representing one or more predetermined projectile deployment patterns; and, b) A processor adapted to:

i) Determine the position of the target with respect to the projectile deployment system;

ii) Select a projectile deployment pattern in accordance with position of the target; and, iii) Selectively activate the charges in accordance with the pattern data.

The projectile deployment system may include one or more sensors for sensing the target, the processor being adapted to monitor the sensors to thereby determine the position of the target with respect to the projectile deployment system.

The controller can be coupled to a remote sensing system via a communications system, the remote sensing system being adapted to:

a) Determine the position of the target with respect to the projectile deployment system; and, b) Transfer an indication of the target position to the controller via the communications system.

The pattern data may indicate at least one of:

a) The barrels from which projectiles should be fired; and, b) The rate of deployment of the projectiles.

At least some of the barrels generally extend radially outwardly from the body axis.

The projectile deployment system can include at least one planar barrel array, the planar barrel array including a number of barrels extending radially outwardly from the body axis so as to define a plane perpendicular to the body axis.

The projectile deployment system typically includes a number of planar barrel arrays spaced apart along the body axis.

At least some of the planar barrel arrays can be skewed with respect to each other such that at least one of the planar barrel arrays deploys projectiles in a direction different to at least one other planar barrel array.

The barrels of adjacent barrel arrays may be partially interleaved.

One or more of the planar barrel arrays may be rotatably mounted to the body to thereby rotate about the body axis.

At least some of the barrels may extend in a direction parallel to the body axis.

At least some of the barrels may define a barrel array for deploying projectiles in directions along and outwardly from the body axis.

The projectile target intercepting device can be a kill vehicle, the kill vehicle including;

a) A propellant system for propelling the kill vehicle; and, b) A flight controller, the flight controller being adapted to control the propellant system to thereby control the kill vehicle trajectory.

The propellant system can be adapted to be propelled in a direction substantially parallel to the body axis. The projectile target intercepting device may alternatively be a missile.

In a second broad form the present invention provides a method of manufacturing a projectile deployment system, the method including:

a) Providing a body member defining a body axis;

b) Providing a support material surrounding the body member, the support material including a number of first and second connectors embedded therein;

c) Drilling a number of holes in the support material to thereby define one or more barrels, the barrels being circumferentially spaced around the body axis and being adapted to intersect selected ones of the first and second sets of connectors; and, d) Inserting projectiles and associated charges into the barrels, the projectiles including first and second connections, the projectiles being aligned such that:

i) The first connections of each of the projectiles in a respective set of barrels are coupled to a respective set of first connectors; and, ii) The second connections of respective projectiles in different sets of barrels are coupled to respective second connections.

The method can include:

a) Mounting a control system within a cavity in the body member; and, b) Coupling the control system to the sets of first connectors and the second connectors.

The method typically includes manufacturing a projectile deployment system according to the first broad form of the invention.

In a third broad form the present invention provides a method of manufacturing a projectile deployment system, the method including:

a) Providing a body member defining a body axis;

b) Coupling a number of barrels to the body member, the barrels being circumferentially spaced around the support axis, the barrels including a number of connectors;

c) Inserting projectiles and associated charges into the barrels, the projectiles including first and second connections adapted to be aligned with respective ones of the number of connectors; and, d) Mounting a control system in the cavity, the control system being coupled to the connectors to allow the projectiles to be deployed.

The method typically includes manufacturing a projectile deployment system according to the first broad form of the invention.

In a fourth broad form the present invention provides apparatus for intercepting a target, the apparatus including:

a) A projectile deployment system having:

i) A body; and, ii) A number of projectile systems mounted to the body, each projectile system being adapted to deploy a number of projectiles in a predetermined direction with respect to the body; and, b) A controller, the controller being adapted to selectively activate one or more of the projectile systems to thereby deploy projectiles in accordance with a projectile deployment pattern.

The apparatus may include:

a) A vehicle having a vehicle body defining a vehicle axis;

b) A propellant system for propelling the vehicle; and, c) A flight controller, the flight controller being adapted to control the propellant system to thereby control the vehicle trajectory.

The apparatus can include a projectile deployment system according to the first broad form of the invention.

The projectile deployment system can be aligned such that the vehicle axis is substantially coaxial with the body axis.

The deployment of each projectile can cause a reactive force along the respective barrel, the pattern of projectiles being at least one of:

a) Symmetric around the body axis to thereby equalise the reactive forces on the body; and, b) Non-symmetric around the body axis to thereby generate non-symmetric reactive forces, thereby causing deflection of the body.

The firing pattern of the projectiles may be adapted to control the trajectory of the vehicle.

The target can be a missile.

The projectile deployment pattern can be selected to thereby increase the effective cross sectional area of the vehicle.

The controller typically includes:

a) One or more sensors for sensing the target; and, b) A processor adapted to:

i) Monitor the sensors to thereby determine the position of the target with respect to the missile;

ii) Determine a projectile deployment pattern;

iii) Select one or more of the projectile systems in accordance with the projectile deployment pattern; and, iv) Activate the selected projectile systems.

The controller can include a store for storing pattern data representing a number of different projectile deployment patterns, the processor being adapted to select one of the stored projectile deployment patterns in accordance with the position of the target.

The vehicle is typically at least one of a kill vehicle and a missile.

In a fifth broad form the present invention provides a missile for intercepting a target, the missile including:

a) A missile body defining a missile axis; and, b) Apparatus according to the fourth broad form of the invention.

In a sixth broad form the present invention provides a method of intercepting targets, the method including:

a) Launching a device at the target, the device including:

i) A body; and, ii) A number of projectile systems mounted to the body, each projectile system being adapted to deploy a number of projectiles in a predetermined direction with respect to the body; and, b) Selectively activating one or more of the projectile systems to thereby deploy projectiles in accordance with a projectile deployment pattern such that at least one of the projectiles intercepts the target.

The method may include:

a) Determining the position of the target with respect to the device;

b) Select a projectile deployment pattern in accordance with position of the target; and, c) Activating the projectile systems in accordance with the selected projectile deployment pattern.

Each projectile system typically includes:

a) A barrel defining a barrel axis extending from a breach end to a muzzle end;

b) A number of projectiles axially stacked along the barrel axis; and, c) A number of charges, each charge being associated with a respective projectile, and being adapted to urge the respective projectile along the barrel to thereby deploy the projectile, the method including selectively activating the charges to thereby generate the selected projectile deployment pattern.

The method is preferably performed using at least one of:

a) A projectile deployment system according to the first broad form of the invention; and, b) Apparatus according to the fourth broad form of the invention.

BRIEF DESCRIPTION OF THE DRAWINGS

An example of the present invention will now be described with reference to the accompanying drawings, in which:—

DETAILED DESCRIPTION OF THE PREFERRED EMBODIMENTS

An example of a kill vehicle suitable for intercepting targets, such as other missiles, will now be described with reference to FIG. 2.

Kill vehicles may come in any one of a number of forms, depending on the circumstances in which the kill vehicle is to be used. Thus, for example, the kill vehicle could be adapted to be used above the earth's atmosphere in orbital applications, for example to intercept targets such as ICBMs. In this case, the kill vehicle will generally be launched into orbit by appropriate rocket systems, such as a missile, or the like, and then deployed into orbit ready for subsequent use. Alternatively, the kill vehicle may be integrated into a missile, allowing the missile to deploy projectiles, as will be described below.

Figure 1:
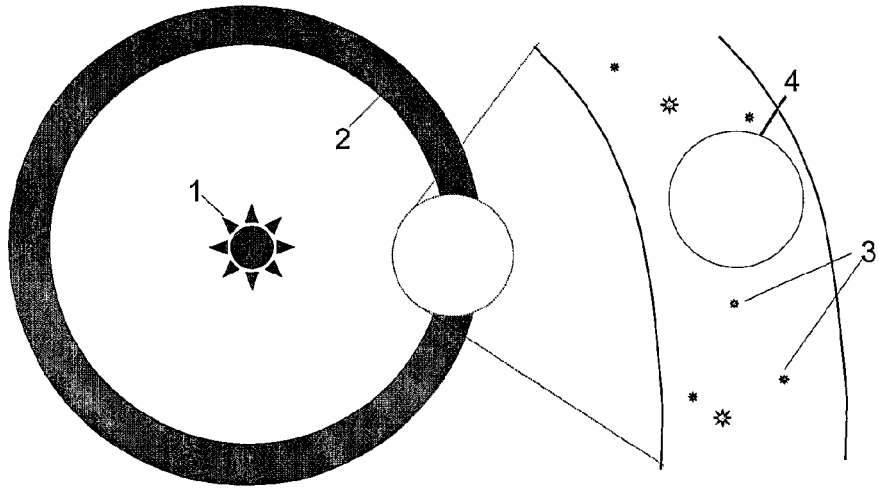
Prior Art Fig. 1
FIG. 1 is a schematic diagram of a fragmentation pattern generated by a prior art missile.
Figure 2:
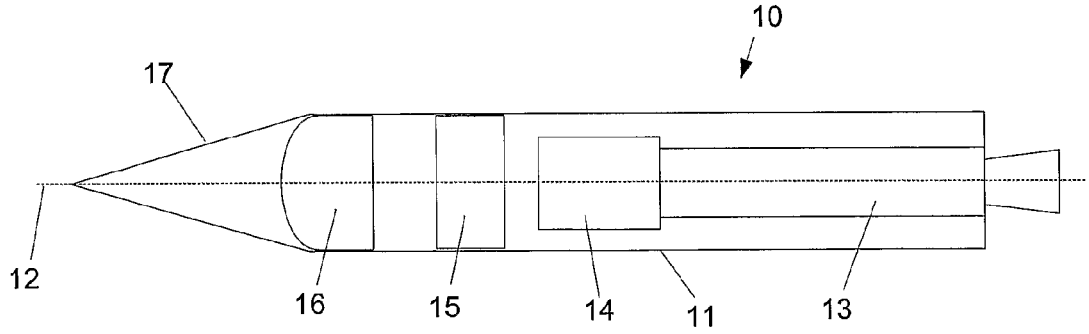
FIG. 2 is a schematic diagram of a missile incorporating a number of barrel assemblies.

An example of a typical kill vehicle construction is shown in FIG. 2. In this example, the kill vehicle 10 includes a body 11 having a generally cylindrical shape defining a body axis 12. The body generally includes a propulsion system 13 and an associated flight control system 14, which is adapted to control the trajectory of the kill vehicle in flight, as will be appreciated by persons skilled in the art. In the example shown a shroud is included to provide streamlining for in atmosphere use, although it will be appreciated that this is not required for use outside an atmosphere.

In use, the kill vehicle is typically propelled towards a target missile with the trajectory of the kill vehicle being constantly updated by the flight control system 14 in an attempt to directly hit the target missile. However, as discussed above, the chance of such a direct hit is minimal and accordingly, in order to increase the chances of the kill vehicle 10 disabling the target missile the kill vehicle 10 includes projectile assemblies for deploying projectiles. The projectiles are adapted to be deployed in a predetermined deployment pattern to thereby increase the effective collision cross sectional area of the kill vehicle 10, thereby increasing the chances of the missile or one of the associated projectiles hitting the target.

In addition to this, target missiles often deploy sub-munitions, multiple warheads, or decoys, such as chaff or balloons to prevent complete interception by a kill vehicle. Accordingly, the deployment of projectiles in a forward direction by the kill vehicle can allow the decoys to be cleared prior to an interception, as well as ensuring that all sub-munitions and warheads are intercepted, as will be described in more detail below.

In any event, in this example, two sets of projectile assemblies are provided as shown at 15 and 16, although as will be described in more detail below, a number of different arrangements could be used.

Irrespective of the number of projectile assemblies, in order to produce suitable projectile deployment patterns, it is preferable to be able to launch a large number of projectiles in rapid succession. An example of a projectile assembly suitable for performing this will now be described with reference to FIG. 3.

Figure 3:
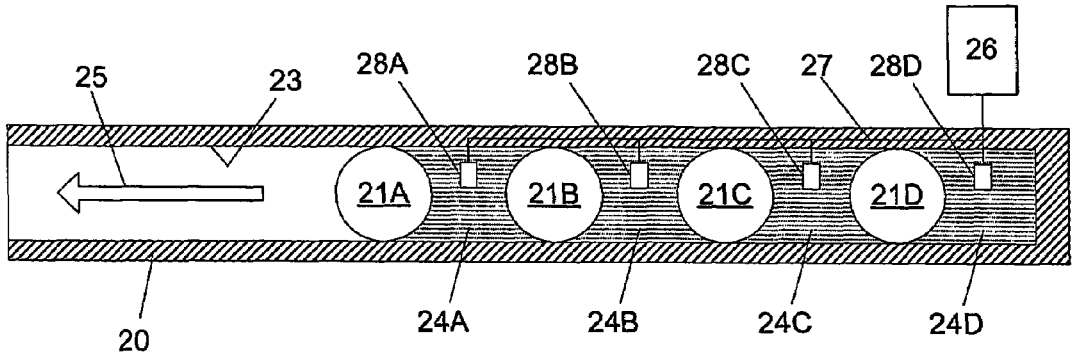
FIG. 3 is a schematic cross section of one of the barrel assemblies of FIG. 2.

In particular, FIG. 3 shows a projectile assembly formed from barrel 20 having a number of projectiles 21 axially disposed therein. In this example, four projectiles 21A, 21B, 21C, 21D are shown, although it will be appreciated that a larger number of projectiles may be used, and four are shown for clarity purposes only. The projectiles 21A, . . . 21D are provided in operative sealing engagement with a bore 23 of the barrel 20, such that activation of an associated propellant charge 24A, . . . 24D will create a region of high pressure immediately behind the respective projectile 21A, . . . 21D thereby urging the respective projectile out of the barrel 20 in the direction of the arrow 25.

In order to deploy the projectiles 21, a firing system is provided as shown generally at 26. The firing system typically includes a circuit adapted to generate electrical pulses, which are then applied via respective connections 27 to respective ignition means 28A, . . . 28D. In use, application of an electrical pulse to a respective one of the ignition means 28A, . . . 28D will activate the associated propellant charge 24A, . . . 24D, thereby causing the deployment of the associated projectile 21A, . . . 21D.

Figure 4:
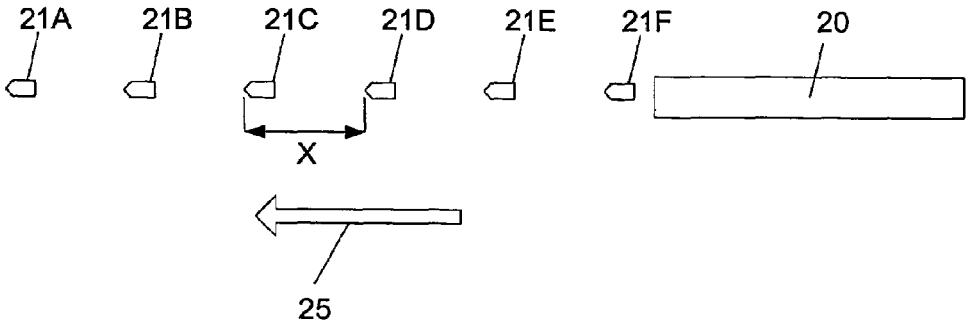
FIG. 4 is a schematic representation of a sequence of projectiles fired from the barrel assembly of FIG. 3.

Accordingly, the firing system 26 is adapted to generate a sequence of the pulses which are applied to each of the ignition means 28A, . . . 28D in turn, thereby causing the projectiles 21A, . . . 21D to be deployed from the barrel in sequence. An example of this is shown in FIG. 4.

Barrel assemblies of this type are capable of firing a sequence of projectiles at regular intervals whereby a predetermined distance X may be established between projectiles in flight, which is useful for producing the required projectile deployment patterns, as will be described in more detail below.

In this example, the distance X between projectiles 21 fired from the barrel may be determined solely by the amount of time between the activation of the successive propellant charges 24. For example, a single barrel of this type can currently fire at up to 45,000 rounds per minute (RPM), consistent with a separation between projectiles of less than 380 mm (15 inches).

In any event, it will be appreciated that a number of variations on the above mentioned barrel assembly can be provided, as described for example in the International Patent Applications PCT/AU94/00124 (published as WO 94/20809) and PCT/AU96/00459 (published as WO 97/04281).

Thus, for example, the projectiles used may be spherical, conventionally shaped or dart-like, depending on the implementation. For example, dart like projectiles can be used to provide sealing engagement between the barrel and the projectiles, thereby allowing the necessary pressure to be generated by the activation of the respective charge to thereby ensure successful deployment.

However, it is possible for the projectiles to be configured so as to define a cavity between the adjacent projectiles. In this case, the propellant charge is located in the cavity, such that the high pressure is created in the cavity between the two projectiles. This avoids the need for the projectiles to seal against the bore of the barrel as the tubular projectiles are adapted to seal nose to tail against one another as opposed to the against the barrel bore.

This can be useful in applications in which the barrel is to be constructed from a material which is susceptible to the high pressures normally generated during projectile deployment, as will be explained in more detail below. As a result, a different configuration of projectile is required as will be described in more detail below.

A further factor is the circumstances in which the projectiles are to be used. For example, in atmosphere applications generally require the use of a streamlined projectile, whereas sub-orbital applications do not.

Atmospheric projectiles may also include fins that generate a stabilising spin as the projectile is propelled from a barrel which may be a smooth-bored barrel.

Alternatively, or additionally the projectiles may be adapted for seating and/or location within circumferential grooves or by annular ribs in the bore or in rifling grooves in the bore and may include a metal jacket encasing at least the outer end portion of the projectile. In this case, shaped rifling can be used to impart spin on the projectiles as they are deployed.

The projectile charge may be form as a solid block to operatively space the projectiles in the barrel or the propellant charge may be encased in metal or other rigid case which may include an ignition means in the form of an embedded primer having external contacts for contacting an pre-positioned electrical contact associated with the barrel. For example the primer could be provided with a sprung contact which may be retracted to enable insertion of the cased charge into the barrel and to spring out into a barrel aperture upon alignment with that aperture for operative contact with its mating barrel contact. If desired the outer case may be consumable or may chemically assist the propellant burn. Furthermore an assembly of stacked and bonded or separate cased charges and projectiles may be provide for reloading a barrel.

Each projectile may include a projectile head and extension means for at least partly defining a propellant space. The extension means may include a spacer assembly which extends rearwardly from the projectile head and abuts an adjacent projectile assembly.

The spacer assembly may extend through the propellant space and the projectile head whereby compressive loads are transmitted directly through abutting adjacent spacer assemblies. In such configurations, the spacer assembly may add support to the extension means that may be a thin cylindrical rear portion of the projectile head. Furthermore the extension means may form an operative sealing contact with the bore of the barrel to prevent burn leakage past the projectile head.

The spacer assembly may include a rigid collar which extends outwardly to engage a thin cylindrical rear portion of the malleable projectile head in operative sealing contact with the bore of the barrel such that axially compressive loads are transmitted directly between spacer assemblies thereby avoiding deformation of the malleable projectile head.

Complementary wedging surfaces may be disposed on the spacer assembly and projectile head respectively whereby the projectile head is urged into engagement with the bore 23 of the barrel 20 in response to relative axial compression between the spacer means and the projectile head. In such arrangement the projectile head and spacer assembly may be loaded into the barrel and there after an axial displacement is caused to ensure good sealing between the projectile head and barrel. Suitably the extension means is urged into engagement with the bore of the barrel.

The projectile head may define a tapered aperture at its rearward end into which is received a complementary tapered spigot disposed on the leading end of the spacer assembly, wherein relative axial movement between the projectile head and the complementary tapered spigot causes a radially expanding force to be applied to the projectile head.

The barrel may be non metallic and the bore of the barrel may include recesses which may fully or partly accommodate the ignition means. In this configuration the barrel houses electrical conductors which facilitate electrical communication between the control means and ignition means. This configuration may be utilised for disposable barrel assemblies which have a limited firing life and the ignition means and control wire or wires therefor can be integrally manufactured with the barrel.

A barrel assembly may alternatively include ignition apertures in the barrel and the ignition means are disposed outside the barrel and adjacent the apertures. The barrel may be surrounded by a non metallic outer barrel which may include recesses adapted to accommodate the ignition means. The outer barrel may also house electrical conductors which facilitate electrical communication between the control means and ignition means. The outer barrel may be formed as a laminated plastics barrel which may include a printed circuit laminate for the ignition means.

The barrel assembly may have adjacent projectiles that are separated from one another and maintained in spaced apart relationship by locating means separate from the projectiles, and each projectile may include an expandable sealing means for forming an operative seal with the bore of the barrel. The locating means may be the propellant charge between adjacent projectiles and the sealing means suitably includes a skirt portion on each projectile which expands outwardly when subject to an in-barrel load. The in-barrel load may be applied during installation of the projectiles or after loading such as by tamping to consolidate the column of projectiles and propellant charges or may result from the firing of an outer projectile and particularly the adjacent outer projectile.

The rear end of the projectile may include a skirt about an inwardly reducing recess such as a conical recess or a part-spherical recess or the like into which the propellant charge portion extends and about which rearward movement of the projectile will result in radial expansion of the projectile skirt. This rearward movement may occur by way of compression resulting from a rearward wedging movement of the projectile along the leading portion of the propellant charge it may occur as a result of metal flow from the relatively massive leading part of the projectile to its less massive skirt portion.

Alternatively the projectile may be provided with a rearwardly divergent peripheral sealing flange or collar which is deflected outwardly into sealing engagement with the bore upon rearward movement of the projectile. Furthermore the sealing may be effected by inserting the projectiles into a heated barrel which shrinks onto respective sealing portions of the projectiles. The projectile may comprise a relatively hard mandrel portion located by the propellant charge and which cooperates with a deformable annular portion may be moulded about the mandrel to form a unitary projectile which relies on metal flow between the nose of the projectile and its tail for outward expansion about the mandrel portion into sealing engagement with the bore of the barrel.

The projectile assembly may include a rearwardly expanding anvil surface supporting a sealing collar thereabout and adapted to be radially expanded into sealing engagement with the barrel bore upon forward movement of the projectile through the barrel. In such a configuration it is preferred that the propellant charge have a cylindrical leading portion which abuts the flat end face of the projectile.

The projectile may be provided with contractible peripheral locating rings which extend outwardly into annular grooves in the barrel and which retract into the projectile upon firing to permit its free passage through the barrel.

The electrical ignition for sequentially igniting the propellant charges of a barrel assembly may preferably include the steps of igniting the leading propellant charge by sending an ignition signal through the stacked projectiles, and causing ignition of the leading propellant charge to arm the next propellant charge for actuation by the next ignition signal. Suitably all propellant charges inwardly from the end of a loaded barrel are disarmed by the insertion of respective insulating ruses disposed between normally closed electrical contacts.

Ignition of the propellant may be achieved electrically or ignition may utilise conventional firing pin type methods such as by using a centre-fire primer igniting the outermost projectile and controlled consequent ignition causing sequential ignition of the propellant charge of subsequent rounds. This may be achieved by controlled rearward leakage of combustion gases or controlled burning of fuse columns extending through the projectiles.

In another form the ignition is electronically controlled with respective propellant charges being associated with primers which are triggered by distinctive ignition signals. For example the primers in the stacked propellant charges may be sequenced for increasing pulse width ignition requirements whereby electronic controls may selectively send ignition pulses of increasing pulse widths to ignite the propellant charges sequentially in a selected time order. Preferably however the propellant charges are ignited by a set pulse width signal and burning of the leading propellant charge arms the next propellant charge for actuation by the next emitted pulse.

Suitably in such embodiments all propellant charges inwardly from the end of a loaded barrel are disarmed by the insertion of respective insulating fuses disposed between insertion of respective insulating fuses disposed between normally closed electrical contacts, the fuses being set to burn to enable the contacts to close upon transmission of a suitable triggering signal and each insulating fuse being open to a respective leading propellant charge for ignition thereby.

A number of projectiles can be fired simultaneously, or in quick succession, or in response to repetitive manual actuation of a trigger, for example. In such arrangements the electrical signal may be carried externally of the barrel or it may be carried through the superimposed projectiles which may clip on to one another to continue the electrical circuit through the barrel, or abut in electrical contact with one another. The projectiles may carry the control circuit or they may form a circuit with the barrel.

The projectiles may have reduced propellant loads moving sequentially towards the rear of the barrel, in order to maintain a constant muzzle velocity.

It will therefore be appreciated that a variety of barrel assembly configurations may be used, and specific examples will be described in more detail below.

In any event, in this example, the sets of projectile assemblies 15, 16 can be mounted to the kill vehicle 10 in a variety of configurations in order to allow a range of projectile deployment patterns to be obtained. For the purpose of example, two main arrangements will now be discussed.

Figure 5:
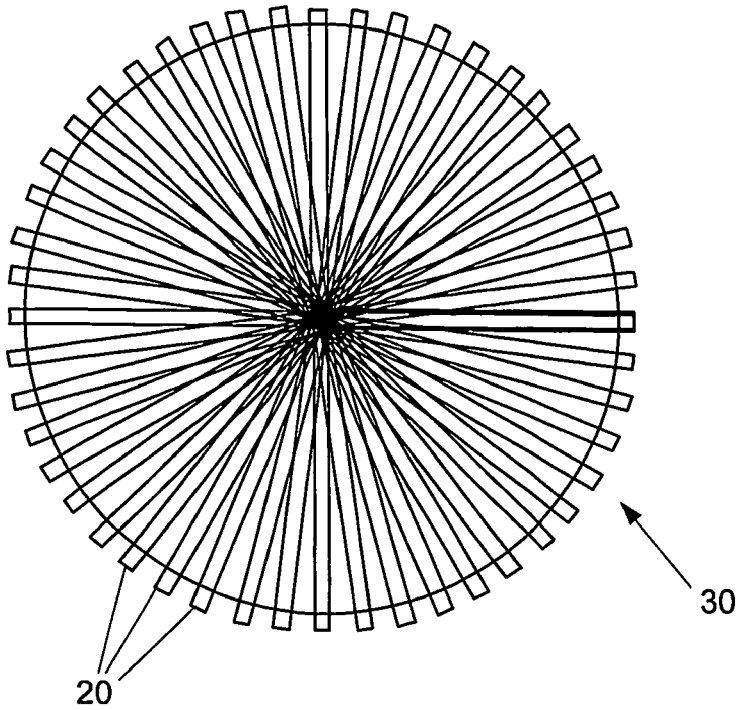
FIG. 5 is a schematic diagram of a first example of a barrel array.

FIG. 5 shows a first example in the form of an arrangement for the first set of projectile assemblies 15. In particular, the arrangement shown in FIG. 5 is formed from a number of barrels 20 that are circumferentially spaced around the body axis 12, and which extend radially outwardly from the body axis 12. Accordingly, the barrels form a planar circular array 30 which is adapted to deploy projectiles at an angle substantially normal to the body axis 12.

Figure 6A:
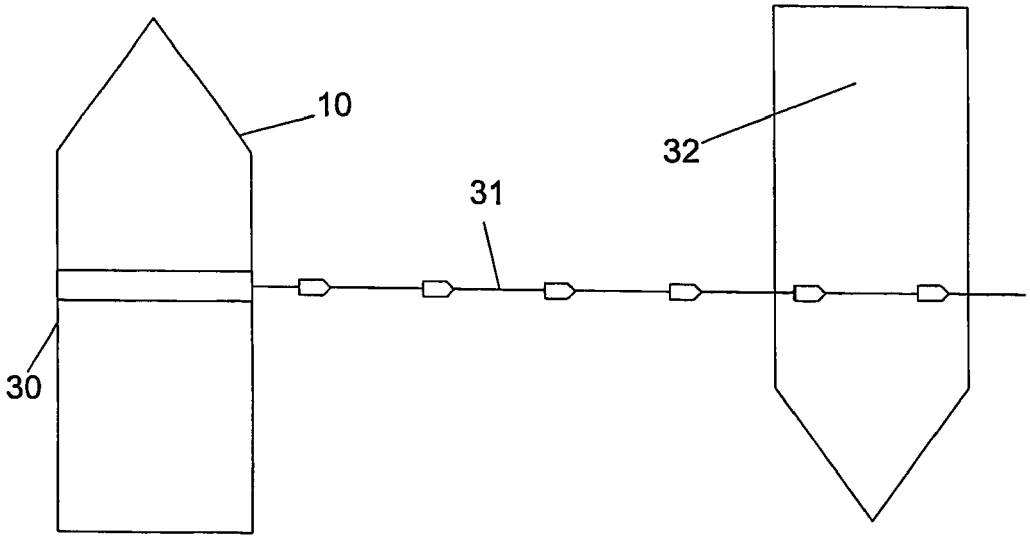
FIGS. 6A and 6B are schematic diagrams showing the position of a line of deployed projectiles relative to a target missile.
Figure 6B:
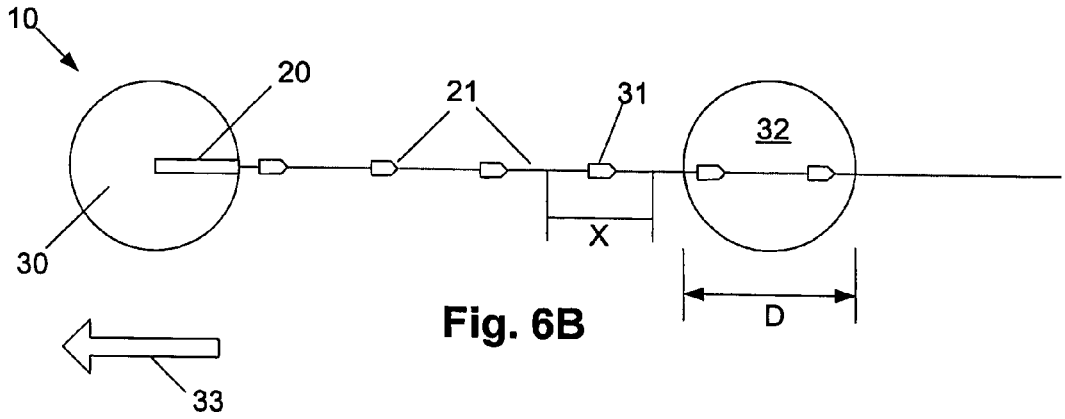

An example of this is shown in FIGS. 6A and 6B, which respectively show plan view and end views of the kill vehicle 10, containing a planar barrel array 30. In this instance, the kill vehicle 10 is shown deploying a line of projectiles 21 from a single barrel 20, as shown generally at 31. The projectiles 21 are directed so as to strike a target 32. In this example, the target 32 is shown to be a missile, although it will be appreciated that the target may be of any form, and may include for example a warhead, sub-munitions, or another kill vehicle. For the purposes of description and ease of explanation only, the target will therefore be referred to as a target missile, although this is not intended to be limiting. In any event, as long as the separation distance X between successive projectiles 21 is less than the cross-sectional diameter D of the enemy missile 32, and as long as the target missile 30 passes through the projectile line 31, then at least one of the projectiles 21 will intercept the target missile 30 as shown.

It will be appreciated by persons skilled in the art that if projectiles are fired from a single barrel 20, then the recoil generated by this deployment will impart a reactionary force on the kill vehicle 10 in the direction shown by the arrow 33. In general, the magnitude of this force will be relatively small due to the small size and mass of the projectiles, and accordingly, the impulse created by the force on the significantly greater mass of the kill vehicle will be small. However, this can result in some change in direction of the kill vehicle.

Accordingly, the barrel array 30 is generally arranged with the barrels 20 being provided in opposition. As a result, opposing barrels $\mathbf{20}_1$, $\mathbf{20}_2$ are generally fired simultaneously, as shown in FIG. 6C, thereby cancelling out the recoil forces on the kill vehicle 10, thereby preventing the kill vehicle being diverted by the deployment of the projectiles.

Figure 6C:
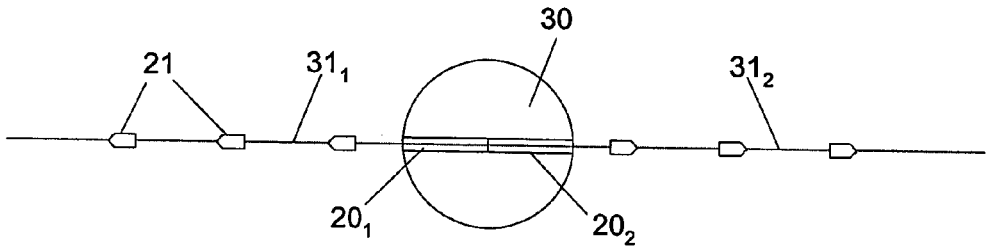
FIG. 6C is a schematic diagram showing the use of projectile deployment in cancelling recoil forces.
Figure 6D:
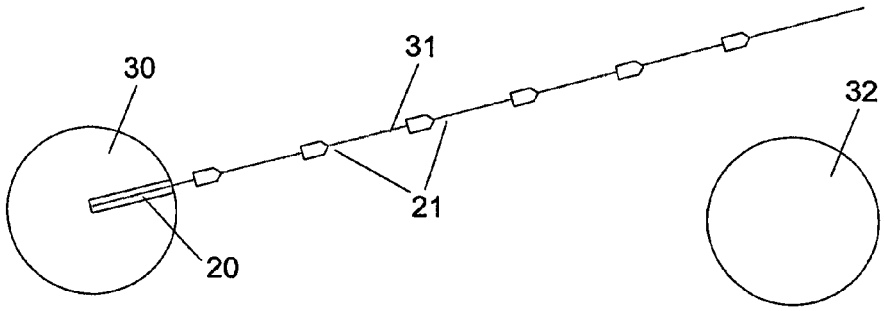
FIG. 6D is a schematic diagram showing the relative positions of a target missile and projectile line.

It will be appreciated that deploying a single one of the barrels 20 to produce a single projectile line 31, as shown in FIGS. 6A and 6B, or a dual deployment as shown in FIG. 6C, can make it difficult to ensure that the target missile 32 is hit. In particular, if the barrel 20 selected for projectile deployment is not be aligned with the target missile 32, then the projectile line 31 and the target missile 32 do not coincide, as shown in FIG. 6D.

Figure 7:
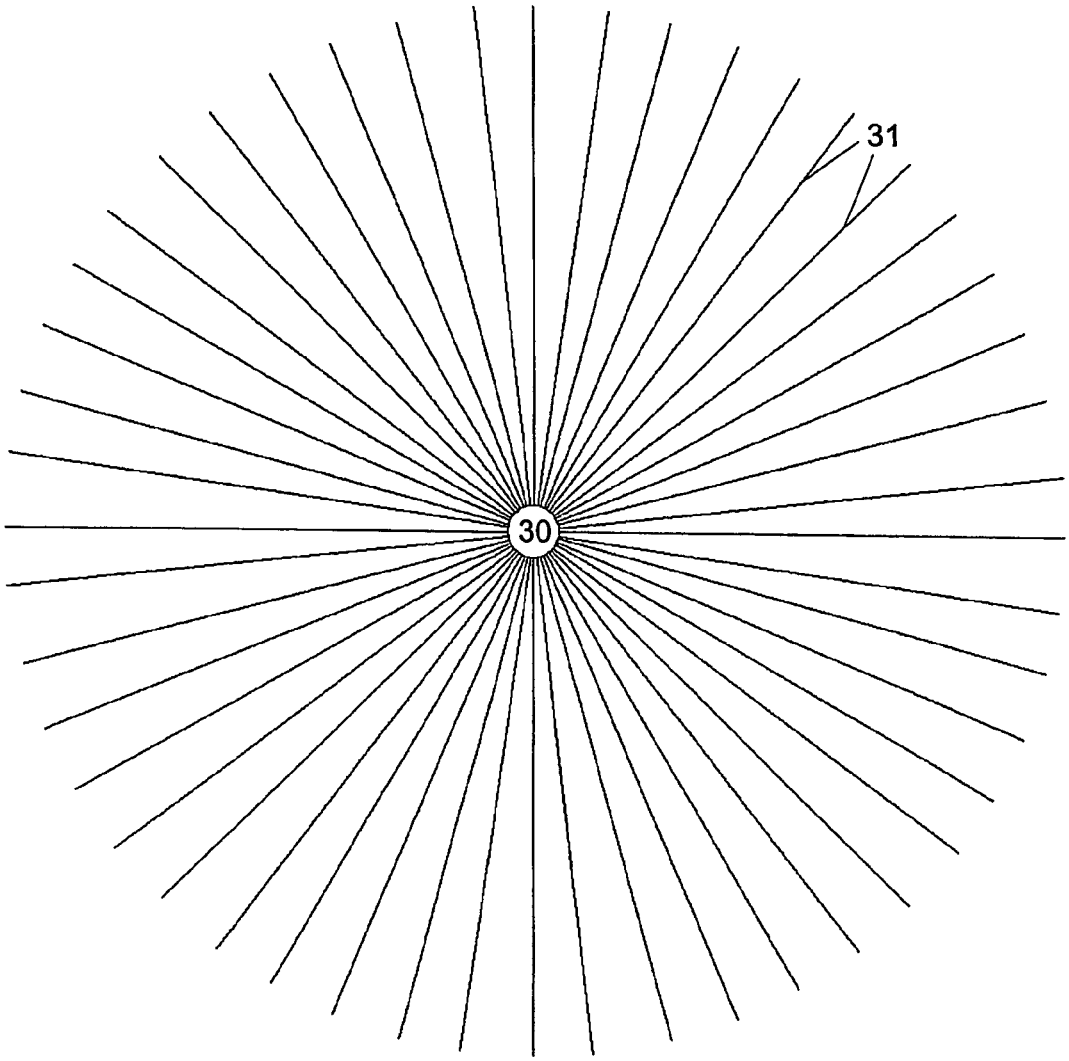
FIG. 7 is a schematic diagram showing the deployment of projectiles in a grid.

Accordingly, it is typical to deploy projectiles from a number of the barrels in a single barrel array simultaneously to thereby provide a covering fire over an area, as opposed to along a single line, as shown in FIG. 7, which shows the projectile lines for each of the barrels 20 in a single array 30.

Figure 8A:
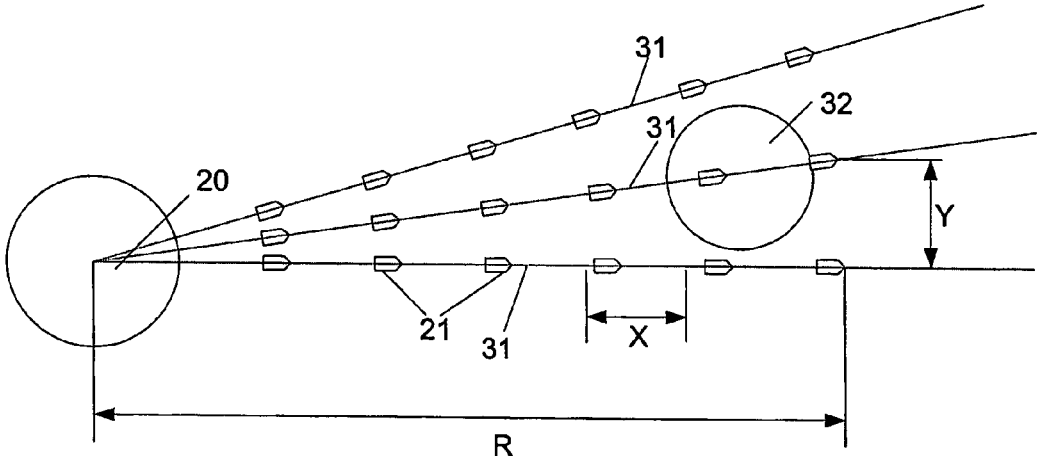
FIGS. 8A and 8B are schematic diagrams showing the size of a target missile and the relative separation of projectiles in the grid deployment pattern.

As shown in FIG. 8A, in order to guarantee a projectile impacting on a target missile 32, it is necessary to ensure that the barrel array 30 is configured so that the separation distance X between each projectile 21 in a projectile line 31, and the separation distance Y between respective projectile lines 31 from adjacent barrels 20, is smaller than the diameter D of the target missile 32. Thus:

$$D \geqq X, Y$$

It should be noted that FIG. 8A shows only three projectile lines 31, and that typically projectiles 21 will be deployed from opposing barrels 20 in order to balance the recoil forces, and that more typically projectiles will be deployed from all of the barrels in the array 30 simultaneously as described above. This illustration is for example purposes only.

In any event, as the barrels 20 face radially outwardly from the kill vehicle body axis 12, the distance between each projectile line 31 increases further from the kill vehicle 10, such that the first fired or lead projectiles have the greatest separation from one another. It is possible to define a deployment radius R as the radial distance of the lead projectile from the missile axis 12 when:

all the projectiles 21 have been fired from the barrels 20 in the array 30; and, the distance between the kill vehicle 10 and the last deployed projectile is equal to the separation distance X.

Accordingly, the projectile deployment pattern is generally configured such that the separation distance Y between the lead projectiles 21A of adjacent projectile lines 31 is less than the missile diameter D whilst all the projectiles 21 lie within the deployment radius R. This ensures that the as long as the target missile 32 is within the deployment radius, it will be hit by at least one projectile.

Figure 8B:
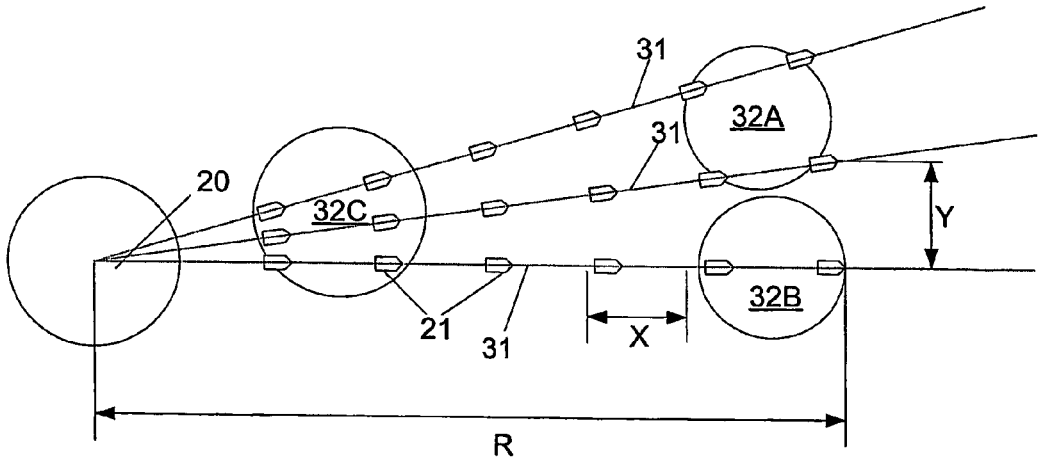

A single hit is however relatively unlikely, since the target missile 32 must pass through a specific point in the deployment pattern which provides a 'gap' amongst surrounding projectiles as depicted in FIG. 8A. A much more likely scenario is that the target missile 32 will be hit by between two and four projectiles, as shown by the target missiles 32A, 32B in FIG. 8B. FIG. 8B also highlights that for a projectile deployment pattern of this form, there is a significantly higher density of projectiles near the kill vehicle 10 itself, thereby further increasing the number of potential hits, as shown by the target missile 32C.

It is also notable that, unlike the prior art, the hits are not merely fragmentary interceptions, but impacts by projectiles 21 which generally have higher mass than fragments. It is also observed that the high speed of the target missile 32, which may be an ICBM or the like, in relation to the projectiles 21, means that the deployed projectile field virtually 'waits' for the target missile 32 to pass through the entire area or volume of the field. (A three dimensional field of projectiles will be described below). For example, the projectiles 21 will typically move less than 5 cm for every meter that the target missile 32 moves. This is simply factored into the firing system timing to deploy the projectiles 21 in accordance with a predetermined deployment pattern as will be described in more detail below.

In general, the projectile deployment pattern described above can be improved by providing a number of barrel arrays 30. An example of this will now be described with respect to FIGS. 9A, 9B and 9C. In this example, a number of barrel arrays 30 are aligned along the missile body axis 12 to form a generally cylindrical matrix 34 of barrel arrays 30. For example, fifty barrel arrays 30 could be stacked together to form a cylindrical matrix 34 which would be approximately 750 mm in length.

In this example, the barrels 20 in adjacent arrays 30 can be aligned with one another. However, it will be appreciated that an improved area of coverage can be achieved by skewing adjacent barrel arrays 30 with respect to each other, as shown for example in FIGS. 9B and 9C, which show two adjacent barrel arrays 30A, 30B, having respective barrels 20A, 20B skewed with respect to each other, as shown.

Figure 10:
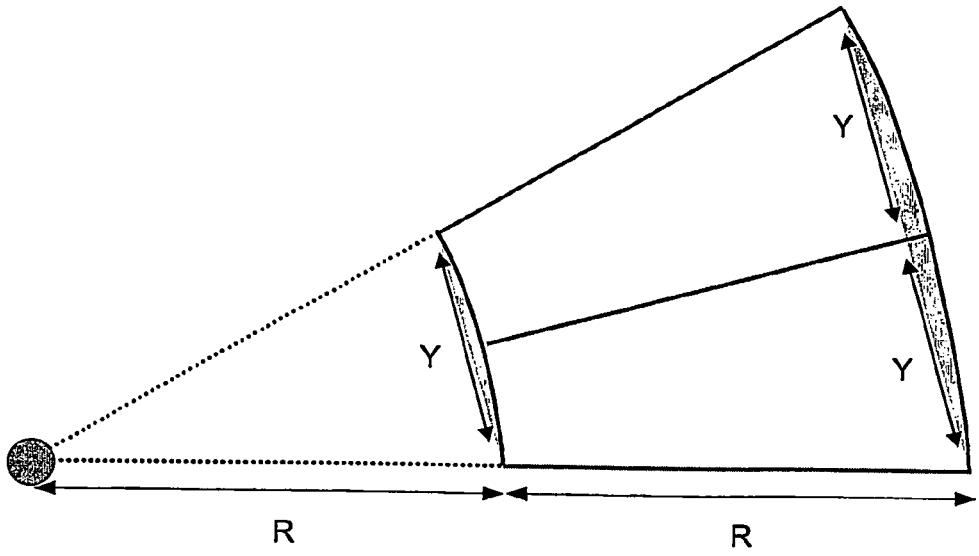
FIG. 10 is a schematic diagram showing the relationship between the deployment radius R and projectiles separation Y.

FIG. 10 shows that for any two projectile lines at the deployment distance R, the two projectile lines are separated by a distance Y, then at twice the deployment radius R, the projectile lines will be separated by a distance of 2Y, and so on.

Figure 9A:
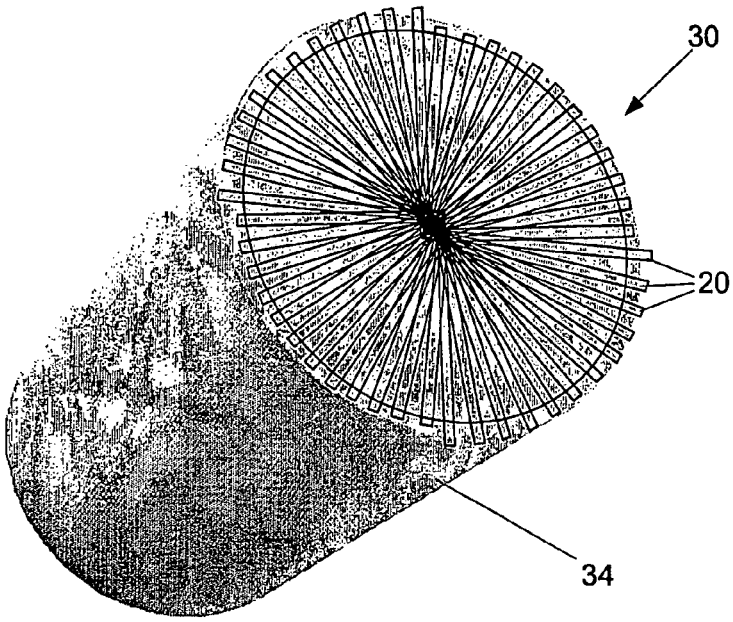
FIGS. 9A to 9C are schematic diagrams of an arrangement of a number of barrel arrays to form a matrix.
Figure 9B:
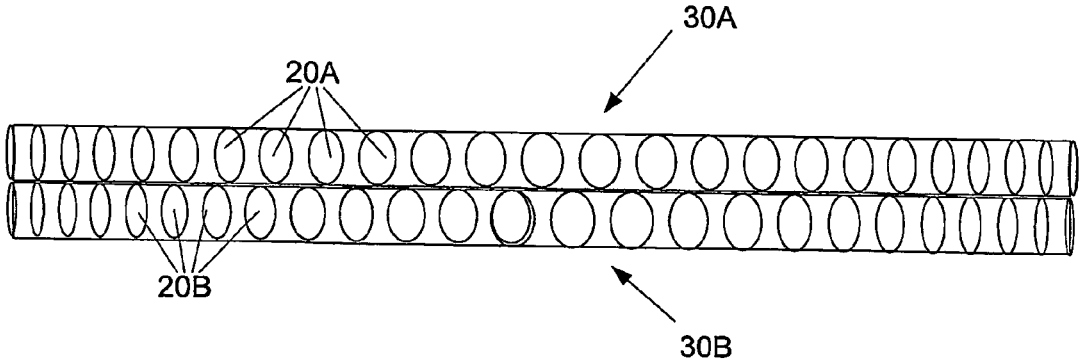
Figure 9C:
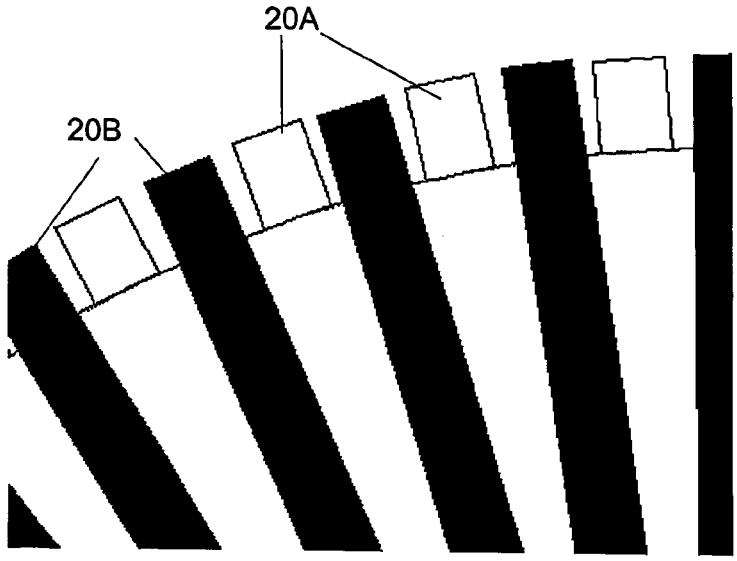

From this it will be appreciated that for barrel arrays 30A, 30B aligned as shown in FIGS. 9B and 9C, this allows a projectile lines 31A, 31B to provide separation of distance Y at twice the deployment radius 2R as could be achieved for a single barrel array. An example of this is shown in FIG. 11.

Figure 11:
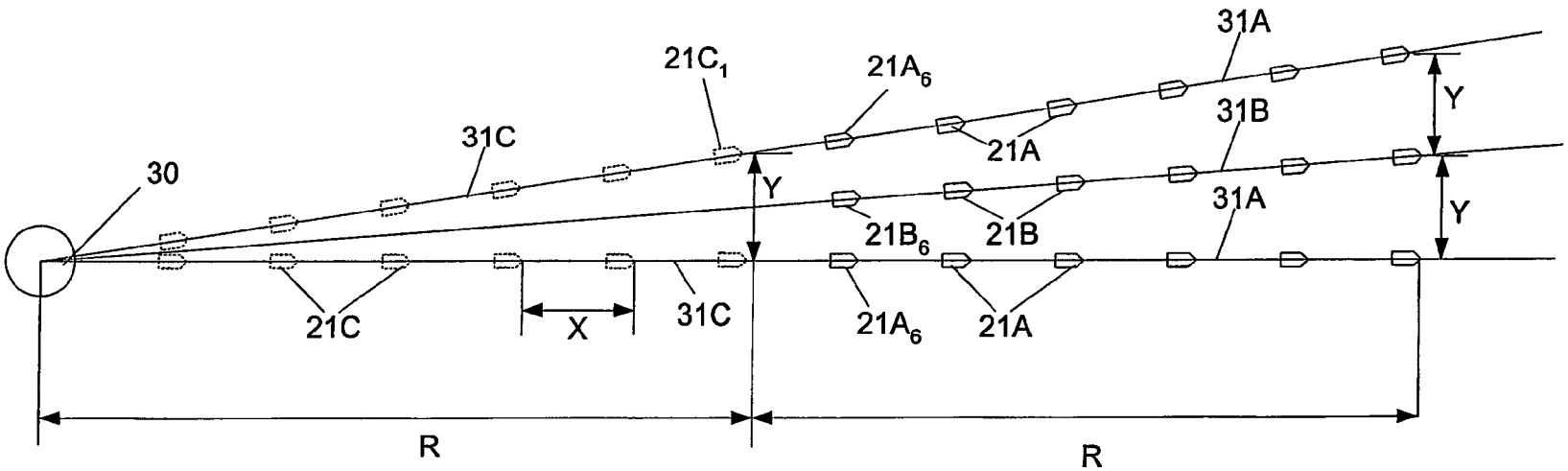
FIG. 11 is a schematic diagram showing the deployment of projectiles from the barrel arrays of FIGS. 9B and 9C to a deployment radius 2R.

It will be appreciated however, that when the lead projectiles reach twice deployment radius 2R, the last projectiles will have travelled to a single deployment radius R, as depicted in FIG. 11. Accordingly, a third barrel array 30C will be required to provide projectile lines 31C to provide coverage within the area defined by a single deployment radius R. In this case, the lead projectiles 21C, of the third array 30C are desirably timed to be deployed sequentially after the last projectiles $\mathbf{21}A_6$, $\mathbf{21}B_6$ of the first and second arrays 30A, 30B have been deployed.

It will be appreciated from this that by combining the projectile deployment patterns of different barrel arrays in combination, this allows a range of different areas to be covered by the projectile deployment pattern. This therefore requires that deployment from each of the barrel arrays must be controllable, as will be explained in more detail below.

In the example shown in FIGS. 9A and 9B, the barrel arrays 30A, 30B are skewed so that the barrels 20B of the array 30B fall between the barrels 20A of the array 30A. However, it will be appreciated that this does not need to be the case. For example, the barrel arrays 30 could be skewed by an amount depending on the number of barrel arrays 30, and the number of barrels 20 in each array 30. This is performed such that each array 30 is skewed by the same amount with respect to each adjacent barrel array 30 so that the barrels in arrays 30 at each end of the barrel array matrix 34 are substantially aligned. Thus, the degree of skew can be linear along the length of the matrix 34.

Alternatively however, barrel arrays 30 may be provided in batches of two or three, which are skewed with respect to each other, as described above in FIGS. 9B, 9C, with adjacent batches being skewed with respect to each other to thereby provide a further improved field of coverage. It will therefore be appreciated that a range of different degrees of skewing between adjacent barrel arrays 30, and between adjacent groups of barrel arrays can be used to provide enhanced coverage of the deployed projectile pattern.

A further variation is for the barrel arrays 30 to be rotatably mounted to a central support, to allow the barrel arrays to be rotated around the body axis 12 with respect to each other. This allows the projectile deployment pattern to be modified dynamically before or during projectile deployment, to thereby ensure optimum projectile deployment is obtained, as will be appreciated by persons skilled in the art.

Figure 12:
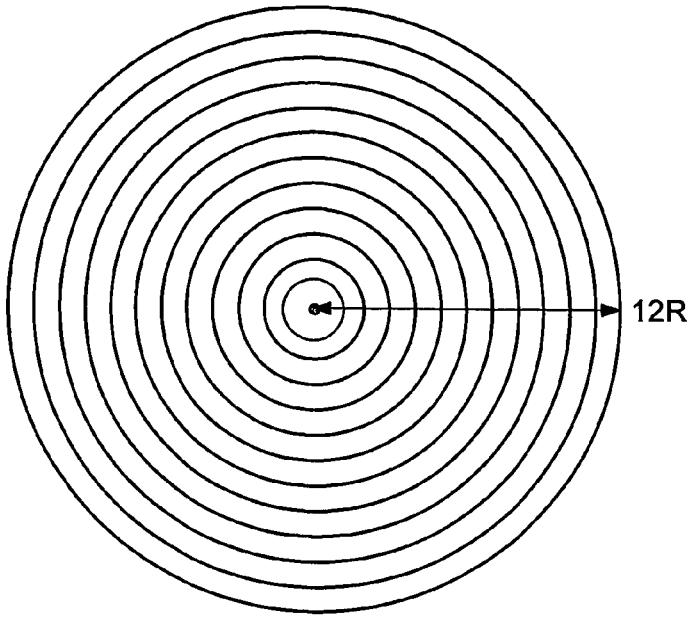
FIG. 12 is a schematic diagram representing the radial extent of three dimensional projectile fields that could be deployed from a cylindrical matrix of barrel arrays.

FIG. 12 is a scaled representation of the radial extent of three dimensional projectile fields that could be deployed from a cylindrical matrix of barrel assemblies, employing multiple skewed circular barrel arrays 30. Distances of up to 12 deployment radii (12R) are shown. The number of circular arrays that would be required in order to deploy to each radius multiple is shown as table 1 below.

TABLE 1

| Area covered in deployment radii R | Number of barrel-arrays required |
|---|---|
| 1 | 1 |
| 2 | 3 |
| 3 | 6 |
| 4 | 10 |
| 5 | 15 |
| 6 | 21 |
| 7 | 28 |
| 8 | 36 |
| 9 | 45 |
| 10 | 55 |
| 11 | 66 |
| 12 | 78 |

The list shows that a cylindrical matrix having fifty planar arrays of barrel assemblies could deploy a field of projectiles to a distance of 9R.

In one example, assuming each barrel 20 includes ten projectiles, and assuming a target missile diameter of 0.5 m, then the deployment radius R is 5 m. It will be appreciated from this, that use of fifty barrel arrays 30 would provide a deployment radius of approximately 45 m, thereby providing the kill vehicle 10 with an effective impact cross sectional area of about:

$$\pi(45)^2=6360\ m^2$$

When compared with the original cross sectional area of the kill vehicle 10 (assuming a 0.5 m diameter similar to that of the target missile 32, which gives a cross sectional area of 0.2 $m^2$), it will be appreciated that the provision of fifty suitably aligned and controlled barrel arrays 30 can lead to a significant increase in the effective interception cross sectional area of the kill vehicle 10.

However, this example relies on each of the barrel arrays being fired in an appropriate sequence to thereby carpet the entire area between the missile and nine times the deployment radius 9R. In this situation, it will be appreciated that there will only be a single projectile line 31 throughout the area surrounding the missile, as shown for example in FIG. 13A.

In this example, it will be noted that the projectile lines 31 are shown to be laterally displaced with respect to each other at different deployment radii distances from the missile. This is due to the forward motion of the missile, during the deployment of the projectiles as shown by the arrow 35. In practice, there would be a continuous distribution of the projectiles from the missile, as shown by the dotted line, and this staggered effect is for clarity only to highlight the different deployment radii.

Figure 13A:
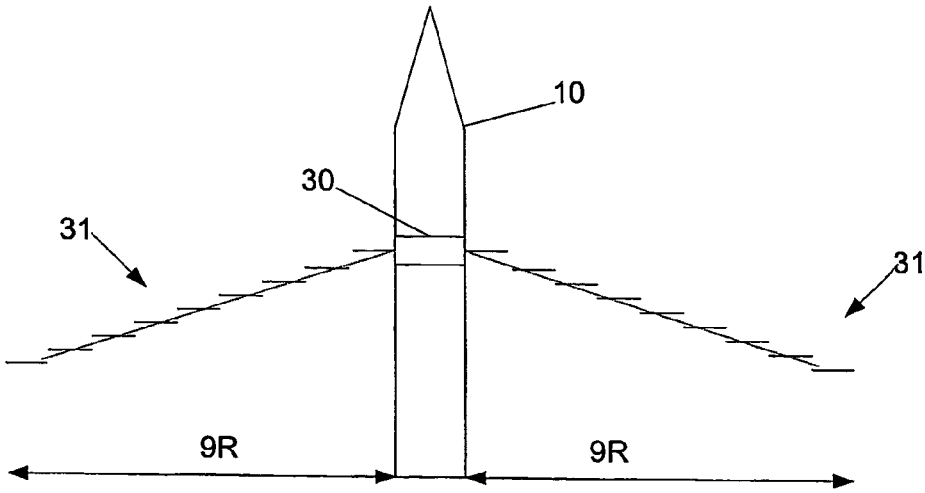
FIGS. 13A to 13C are schematic plan views of the deployment of projectiles from the barrel array configuration of FIG. 9A to varying deployment radii.

In any event, it will be appreciated from FIG. 13A, there deploying the projectiles in accordance with this projectile deployment pattern to maximise the effective cross sectional area of the kill vehicle 10 will result in the deployed projectiles being effectively only one "plane" deep.

Accordingly, it will be appreciated by persons skilled in the art, that alternative firing patterns could be selected to maximise the number of projectiles nearer to the kill vehicle 10. Thus, for example, the matrix of fifty barrel assemblies 30 could be arranged to deploy projectiles out to a maximum effective radius of 5R, or 25 m in this example.

Figure 13B:
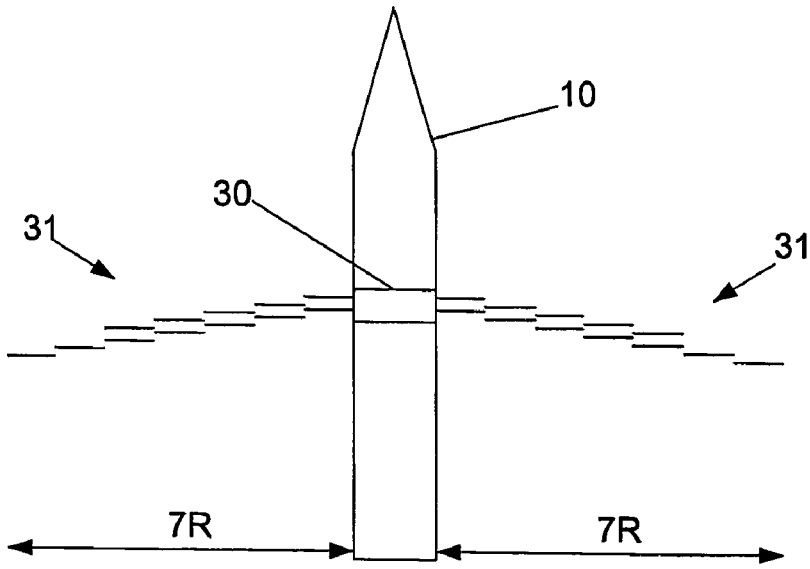
Figure 13C:
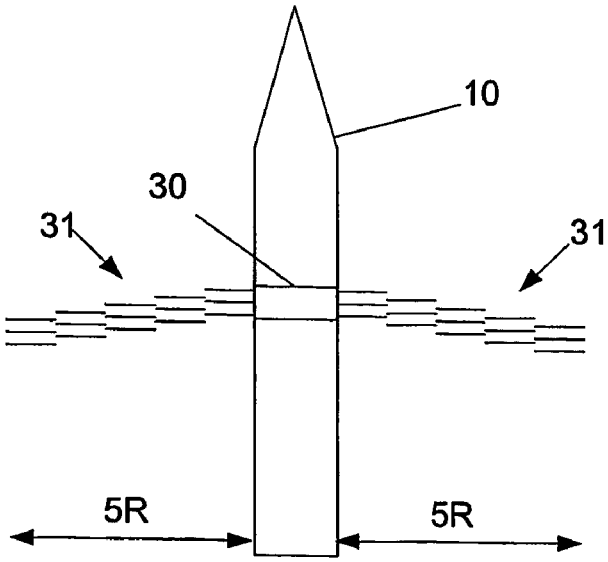
Figure 13D:
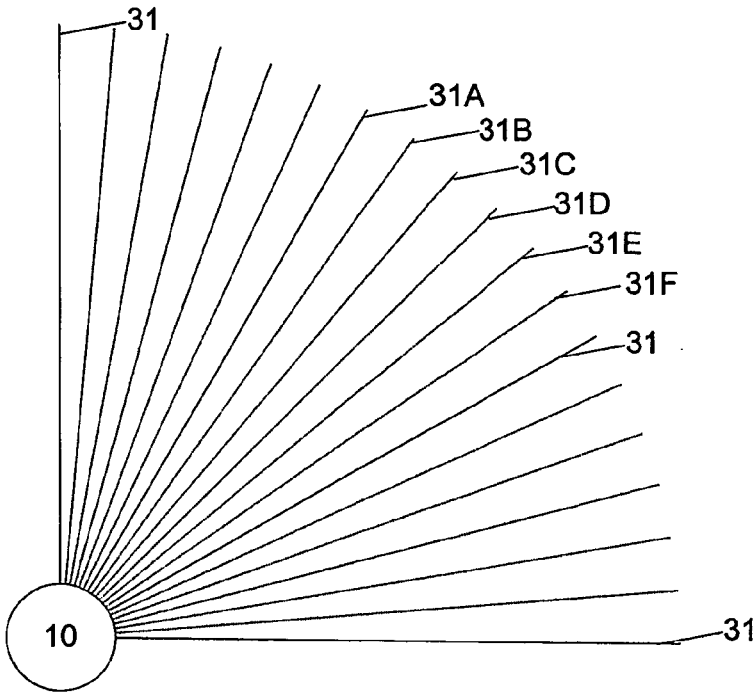
FIGS. 13D to 13F are schematic diagrams of the deployment of projectiles from the barrel array configuration of FIG. 9A to produce respective deployment patterns.

In this case, Table 1 clarifies that this would leave thirty five barrel assemblies to produce a further projectile deployment pattern. Thus, this could be to produce a second plane of projectiles out to a distance of 7R, or two further planes of projectiles out to a distance of 5R, as shown for example in FIGS. 13B and 13C respectively. This in turn would greatly increase the probable number of projectile interceptions within the radius 5R. Furthermore, the additional planes could be skewed with respect to each other, thereby further reducing the separation between respective projectile lines 31, as shown for example by the projectile lines 31A, . . . 31F from respective barrel arrays 30A, . . . 30F in FIG. 13D.

Accordingly, it will be appreciated that particular projectile deployment patterns can be tailored to specific circumstances. Thus, for example, the projectile deployment pattern can be selected based on the relative positions of the kill vehicle 10 and the target missile 32. Alternatively, the projectile deployment pattern may depend on the number and dispersion of any warheads deployed by the target missile 32. Thus, if the target missile 32 has not yet deployed any warheads, the kill vehicle will tend to deploy multiple planes of projectiles to ensure a larger number of hits on the target missile 32. However, if a number of warheads have been deployed, the projectile deployment pattern may be spread over a larger area, to thereby help ensure all the warheads are intercepted.

Figure 13E:
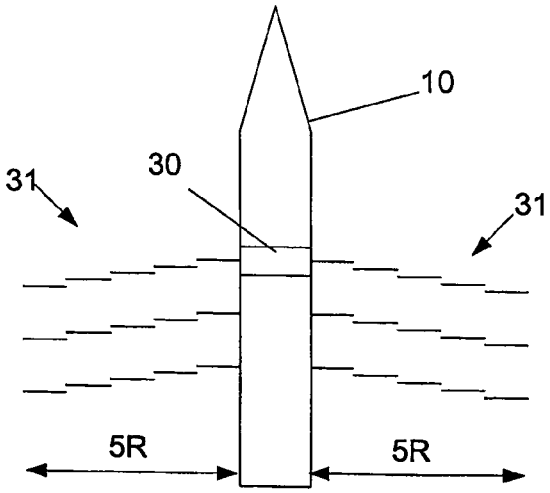

The deployment of projectiles from different planar barrel arrays 30 may also be separated temporally, meaning that the number of deployed planar arrays is not only the divisor as to the distance between adjacent lines of fire (as above), but also as to the distance between projectiles in a line of fire (in end view), as shown for example in FIG. 13E. Accordingly, this option is considered to be advantageous in the event that an enemy missile deploys decoy warheads and other fragments.

Figure 13F:
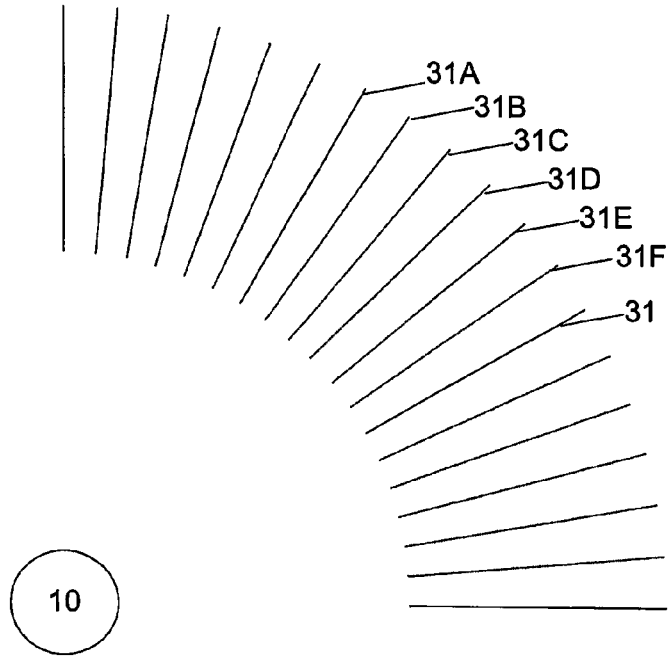

FIG. 13F illustrates an example in which the barrel arrays are fired simultaneously to thereby deploy an annular projectile pattern. It will be appreciated that in this example, in order to maintain the separation Y between adjacent projectile lines 31 at the distance of 9R, the number of barrel arrays required would be nine arrays 30. Thereby providing further flexibility over the interception of targets.

Typically local tracking of the trajectory of the target missile 32 is preferable in order to provide sufficiently flexible fire control, whereby the timing of firing could be adapted to the particular circumstances encountered by the interception missile. This will be discussed in more detail below.

Figure 14A:
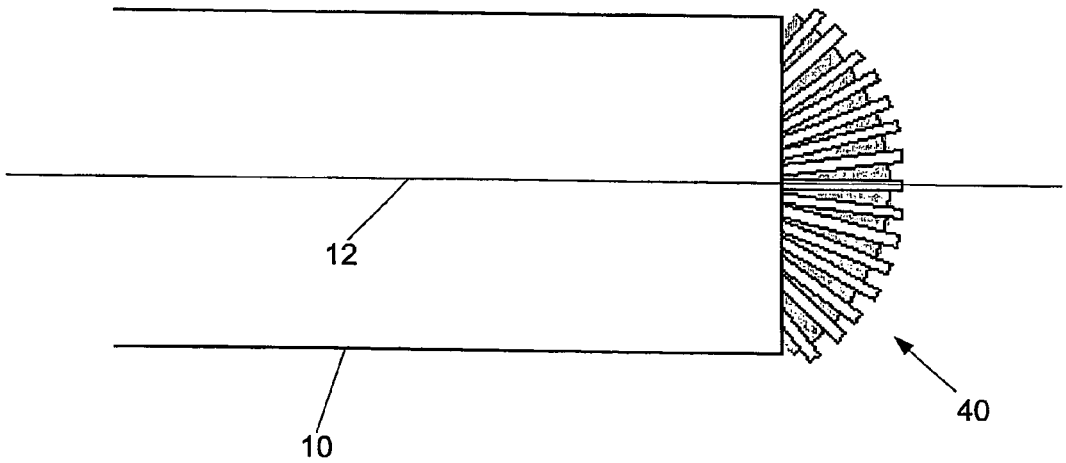
FIG. 14A is a schematic diagram of a second example of a barrel array.

A second example of projectile assembly arrangements will now be described. In this example, a number of projectile assemblies in the form of the barrels 20 are mounted as shown generally in FIG. 14A. In this example, the barrels are adapted to extended both radially outwardly from and in a direction parallel to the body axis 12. Thus, the barrels 20 effectively form a barrel assembly 40 having a partially spherical shape, and which are mounted in the nose of the kill vehicle 10 as shown at 16.

Figure 14B:
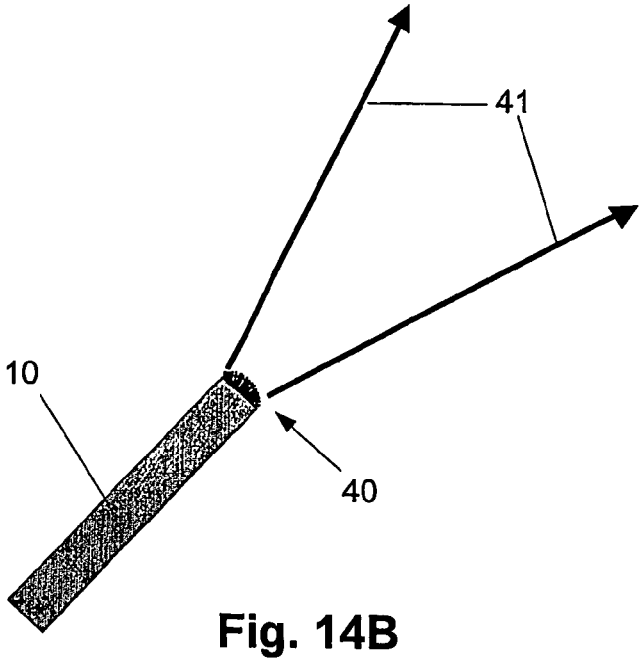
FIG. 14B is a schematic diagram of a projectile deployment pattern from the barrel array of FIG. 14A.

In this example, if the kill vehicle is a missile, or the like, which is deployed in the atmosphere, then it is typical for the barrel array 40 to be protected by a shroud 17 in flight, with the shroud being ejected from the body 11 shortly before the projectiles are deployed from the barrel array 40. However, in the majority of cases in which the kill vehicle is deployed outside the earths atmosphere, then there is no need for a streamlined kill vehicle shape, and the shroud is not required. In any event, as a result of this configuration, the missile is able to deploy projectiles in advance of the kill vehicle 10, as shown in FIG. 14B. In particular, this allows the kill vehicle 10 to deploy a substantially frustro-concial pattern of projectiles as shown generally at 41.

Figure 14C:
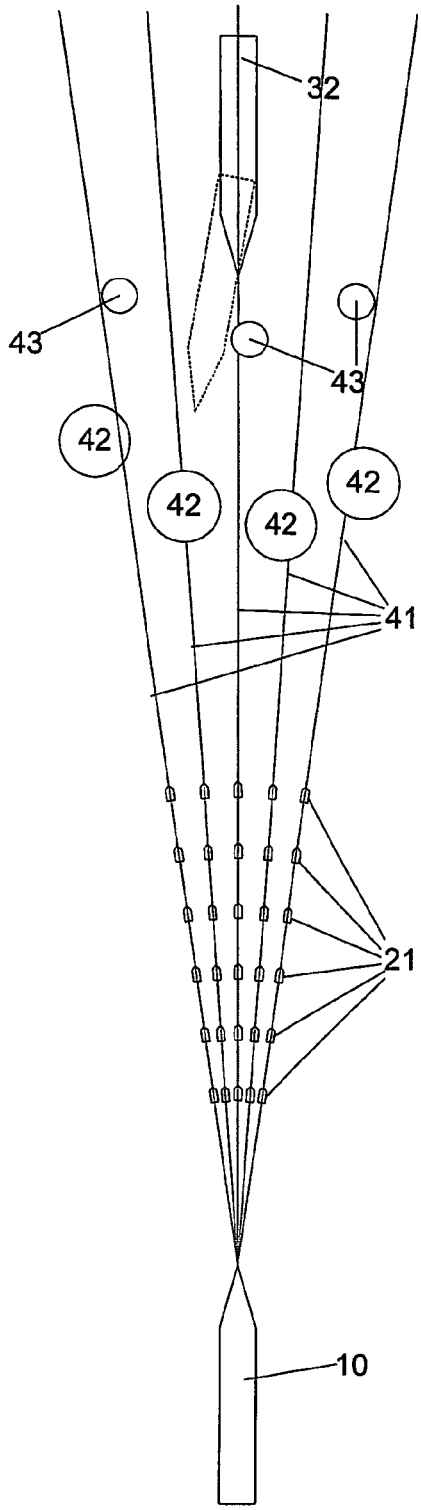
FIGS. 14C to 14E are schematic diagrams of the deployment of projectiles from the barrel array configuration of FIGS. 9A and 14A to destroy a target and decoys.

This is useful in scenarios in which the target missile 32 deploys sub-munitions or decoys, as shown for example in FIG. 14C. In this case, the target missile 32 detects the presence of the kill vehicle 10 and releases decoys 42, such as balloons or chaff, and optionally one or more warheads 43, before altering trajectory as shown by the dotted lines, to thereby avoid the kill vehicle 10. Under normal circumstances, this reduces the chance of a successful interception by the kill vehicle 10.

Figure 14D:
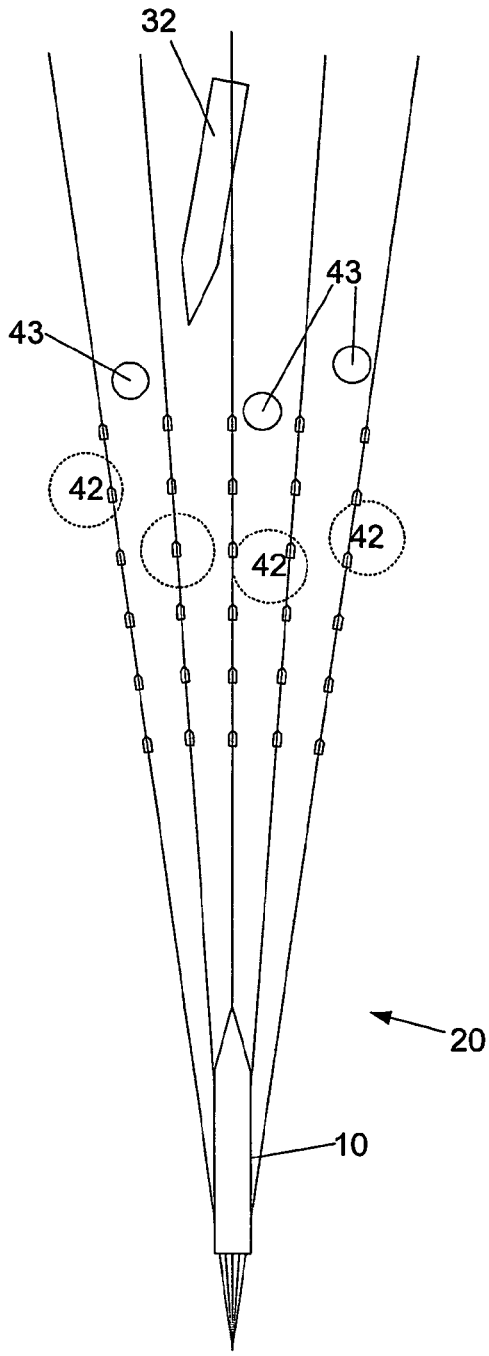
Figure 14E:
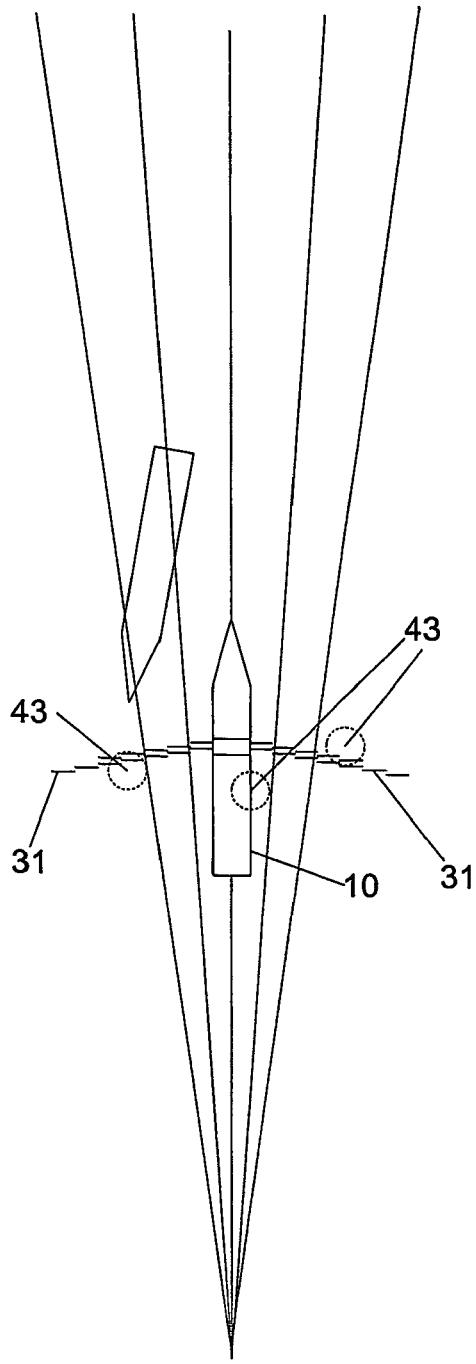

Accordingly, the kill vehicle 10 uses the barrel array 40 to deploy projectiles 21 in advance of the kill vehicle 10, as shown by the projectile lines 41. The projectiles 20 operate to destroy at least the decoys 42, as shown in FIG. 14D, thereby allowing the kill vehicle to determine the position of the target missile 32, and any warheads 43. This in turn allows the kill vehicle 10 to either directly intercept the target missile 32, and/or warheads 43, or to deploy a predetermined projectile pattern, to thereby destroy the target missile 32 and associated warheads 43, as shown in FIG. 14E.

Thus, the use of the array 40 allows the kill vehicle 10 to destroy any decoys in the form of balloons, chaff or the like, before the kill vehicle 10 itself arrives at the intercept position. The kill vehicle 10 can then accurately determine which object is the real target and have enough remaining time to appropriately react.

Since the projectiles are fired forwardly of the kill vehicle 10, there would be a resultant rearward force which would tend to slow the missile. However, this may be used to advantage in that the slowing due to projectile deployment could assist in providing a longer time window for a subsequent hit-to-kill intercept by the body of the kill vehicle 10.

In any event, deployment of the projectiles is governed by similar rules to the deployment of the projectiles in the planar array scenario described above with respect to FIGS. 3 to 13, and will not therefore be described in detail. However, it will be appreciated that by modification of the relative angle between the barrels 20 in the array 40 and the body axis 12, this allows a range of spread of projectiles to be achieved, thereby allowing the relative separation between the projectile lines 41 to be controlled. This, again allows the barrels to be fired in sequence to allow a predetermined separation to be obtained at a predetermined distance from the kill vehicle. This can be used to ensure that any decoys or chaff deployed by the target can be destroyed before the kill vehicle arrives.

Figure 15A:
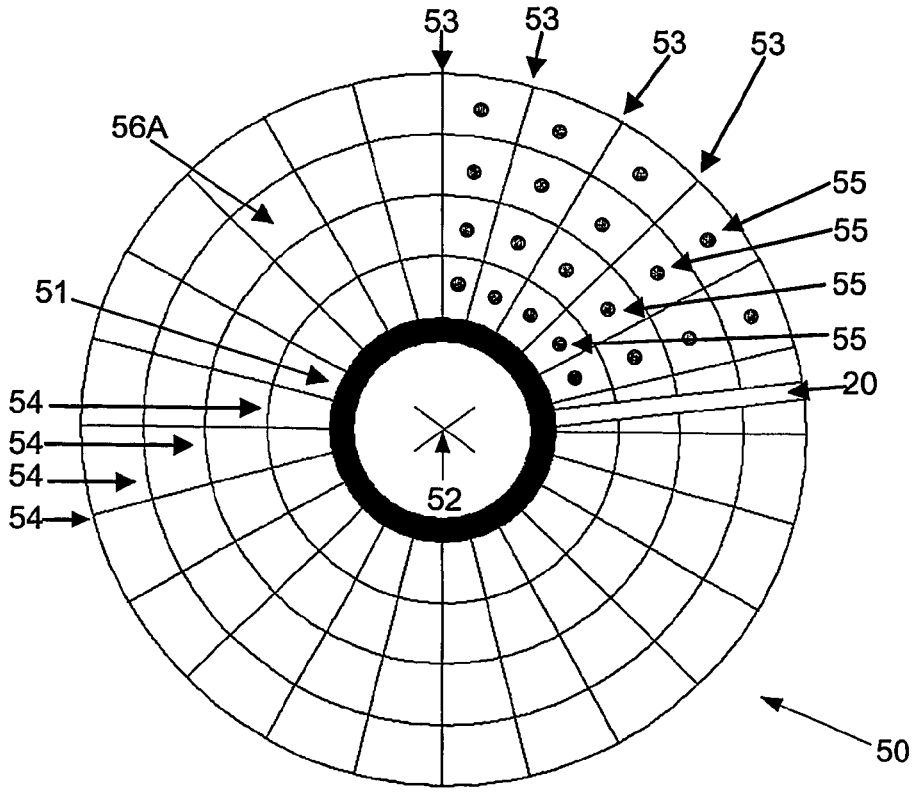
FIGS. 15A to 15E are schematic diagrams of a support system for mounting the barrel array of FIG. 3 in a missile.

A specific example of implementation of the barrel arrays 30 will now be described. In particular, with the barrels extending radially outwardly from a central axis, it is necessary for the barrels 20 to be mounted surrounding a central cylinder so that there is sufficient volume available to accommodate the breach ends of the barrels 20. Accordingly, each barrel array 30 would be constructed using a support system, an example of which is shown in FIGS. 15A and 15C.

As shown the support system 50 includes a central support cylinder 51 having a cylinder axis 52. A number of radial connectors 53 extend radially outwardly from the support cylinder 51. The radial connectors are coupled to circular connectors 54 positioned at respective radii as shown so as to define a conducting mesh plane 56, with a respective mesh plane 56 being provided for each barrel array 30 in the matrix 34. A number of laterally connectors 55 are also provided.

The connectors are embedded in an insulating material such as thermoset plastic which is moulded to form a cylindrical body forming the barrel array matrix 34. In use, the barrels 20 are created in the matrix 34 by drilling cylindrical cavities which extend radially inwardly to the central support cylinder. The cavities are aligned so that the barrels intersect the lateral and circular connectors. Accordingly, the lateral and circular connectors are provided flush with the barrel bore 23, as shown for example in FIG. 15B.

In this configuration, as the lateral connectors 55 are electrically isolated from the mesh planes 56, it will be appreciated that respective mesh planes 56 are electrically isolated from other mesh planes in the matrix.

Figure 15B:
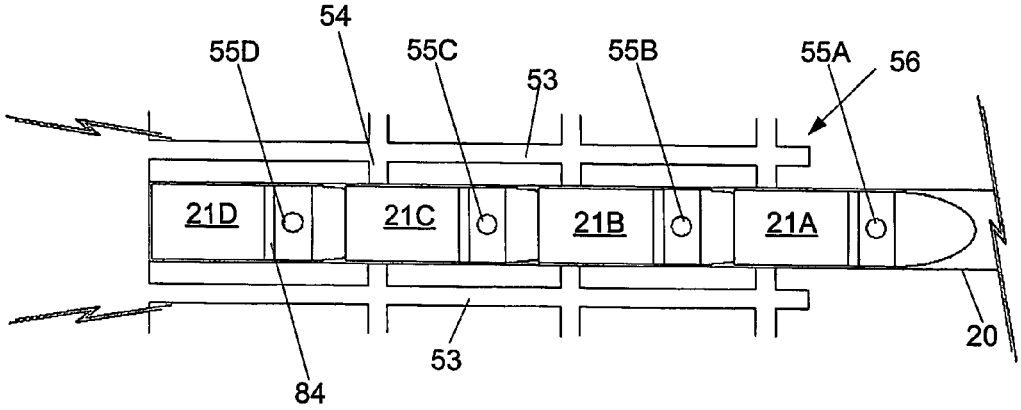
Figure 15C:
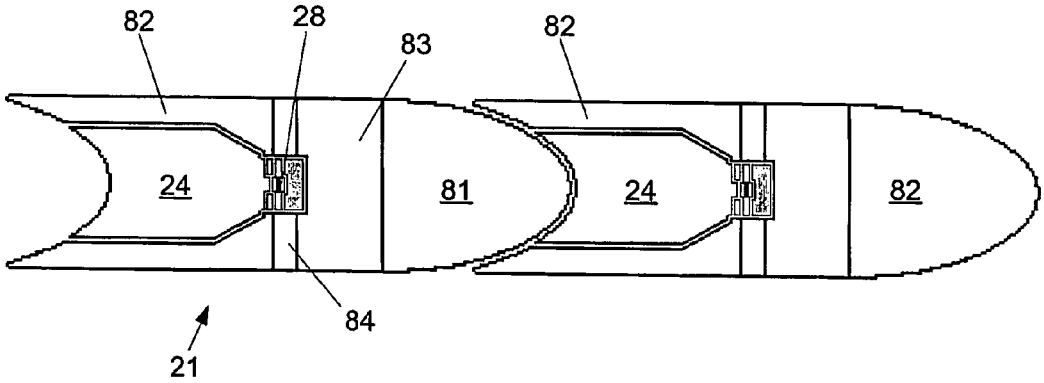

In use, projectiles are inserted into the barrels 20, as shown in FIG. 15B. FIG. 15C shows a cross sectional view of the projectiles 21, which highlights that each projectile includes a shaped nose and tail portion 81, 82. In use the projectiles 21 are inserted into the barrel 20, such that the nose and tail portions 81, 82 of adjacent projectiles cooperate to define a cavity for containing the propellant charge 24. The cavity is sealed such that activation of the propellant charge 24 will generate a high pressure in the cavity, thereby urging the lead projectile along the barrel 20. It will be appreciated that this avoids the need for the projectile 21 to seal against the barrel 20, thereby reducing the pressure and heat to which the barrel is exposed. This allows the barrel to be formed from thermoset plastics (or another suitable non-metallic, or other composite material), rather than requiring a more durable material.

In addition to this, the tail portion 82 is conductive, and is connected to the ignition means 28. The projectile also includes a connection 83, which is also connected to the ignition means 28, such as a semi-conductor bridge (SCB), and which is electrically isolated from the tail portion 82 by the insulating band 84. In use, application of a suitable current between the tail portion 82, and connection 83 can therefore be used to ignite the SCB and thereby activate the propellant charge 24.

In use, the lateral connectors 55 are adapted to align with the connection 83, with the circular connectors 54 being aligned with the tail portions 82, as shown in FIG. 15B. This allows the deployment of the projectiles 21 to be controlled by suitable control electronics which may be completely or partially housed within the central support cylinder 51. This will typically include at least the firing system 26, which is coupled to the lateral connectors 55 through the use of a PCB extending radially outwardly from the central support cylinder. In this example, the PCB can be coupled to the ends of the lateral supports which extend radially beyond the radial arms 53, as shown at 55A. The control electronics will also generally be coupled directly to the mesh planes, which is achieved by having the radial connectors 53 extend into the central support cylinder 51.

Accordingly, this allows the control electronics, which will be described in more detail below to apply predetermined current to the ignition means 28 of selected projectiles of selected barrel arrays by applying the current to appropriate mesh planes 56 and appropriate lateral connectors 55.

In particular, in order to launch a projectile, the controller will use the mesh plane as one terminal, thereby allowing any of the projectiles in the respective barrel array to be deployed. The respective one or more projectiles can then be selected by using the appropriate lateral connectors 55. Thus, for example, applying a current between the connector 55A and the mesh plane 56 shown in FIG. 15B, will cause the projectile 21A to be deployed.

Figure 15D:
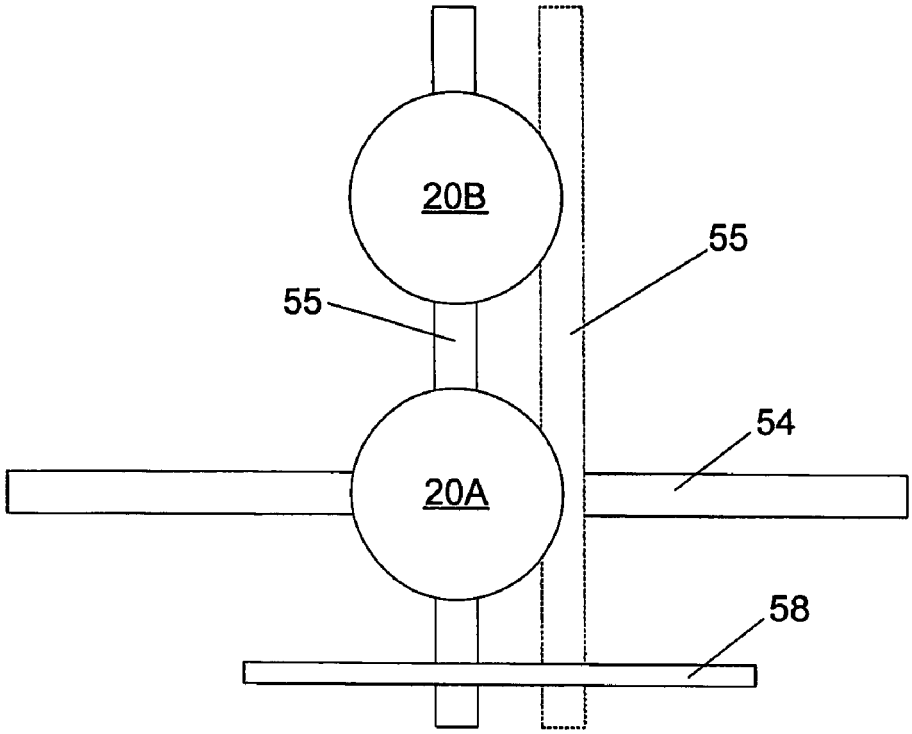

In general a single PCB is provided for the entire matrix 34. Accordingly, the connection 83 extends around each projectile 21, such that the portion of the lateral connector 55 on either side of the barrel 20 is interconnected by the projectile positioned therebetween. An example of this is shown in FIG. 15D, which is a plan view of one of the barrels 20. As shown the PCB 58 is coupled to the barrel 20B via the projectile in the barrel 20A. It will therefore be appreciated that in this configuration once the projectile is deployed from the barrel 20A, this will effectively break the connection provided by the lateral connector 55, thereby isolating the barrel 20B from the PCB 58. This would therefore require that the projectiles are launched in sequence from the end of the matrix 34 furthest away from the PCB 58, in order that remaining projectiles can be deployed.

However, this can be overcome by providing the lateral connector 55 at a position which only partially intersects the barrels 20, as shown in dotted lines. In this case, the lateral connector 55 will remain unbroken when projectiles are deployed from the barrel 20A, thereby allowing projectiles to be subsequently deployed from the barrel 20B, as will be appreciated by persons skilled in the art.

The connectors can be constructed using thin metal rods (2 mm) cast in poly-dicyclopentadiene (PDCPD), or another suitable non-metal or composite material. The thin metal rods would be manufactured as two separate components—in the form of simple rods to form the lateral connectors 55 and as planes of meshed metal rods to for the mesh-planes 56. The planes of meshed metal rods and vertical rods would be positioned in the cast in similar fashion to the configuration of FIG. 15A.

Typically the barrel arrays 30 created in this fashion are skewed with respect to each other. As a result, the lateral supports will need to extend along the length of the matrix 34 in a curved fashion to ensure that they intersect the barrels at appropriate positions to thereby allow connections with the projectiles to be achieved.

In one example, the barrel arrays have a radius of 17.3 cm, with the central support cylinder having a radius of 4.3 cm, allowing 13 cm for the length of each barrel 20. Taking into account the propellant charge 24 and associated projectile 21, each projectile takes up a length of 2 cm, which allows for four projectiles in each barrel, with an additional 5 cm of free bore space.

The projectiles are of 0.22 calibre, giving each barrel a diameter of 5.6 mm. In addition to this, it is typically necessary to incorporate a 0.5 cm spacing between barrel arrays 30, allowing a barrel matrix having an overall axial length of 31.3 cm to incorporate twenty nine barrel arrays 30.

Furthermore, this configuration allows twenty six barrels to be accommodated in each barrel array 30 giving an angle between adjacent barrels of 360/26=13.85 degrees. The base of each barrel would be positioned 4.3 cm from the support cylinder axis, and taking into account the 0.56 cm diameter of the barrels, provides a 0.48 cm gap between adjacent barrels in the barrel array, at the support cylinder surface.

In this configuration, the grid would incorporate twenty six radial connectors 53, and three circular connectors 54 forming each mesh plane. As there are twenty nine barrel arrays, there would be thirty mesh planes vertically stacked within the missile body. There would also be one hundred and four lateral connectors 55. These would be positioned vertically within the gaps in the mesh planes (as in the above example) and at a slight angle to compensate for the 13.85 degree twist between top and bottom mesh plane's. The cylinder would then be cast. Holes to accommodate the barrels are drilled into the cylinder such that the lands of the rifling are cut into the various metal rods. This is so as the rods 'cut' into the contact surfaces of each barrel as they are inserted.

Figure 15E:
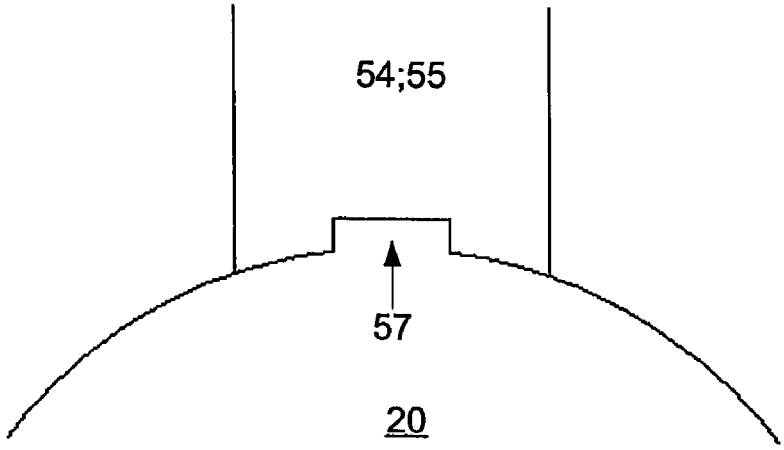

In this example, the barrels may also be drilled to incorporate rifling, as shown for example in FIG. 15E. In this example, the rifling is in the form of a recess 57 extending into the lateral or circular connectors 54, 55, as shown. However, the rifling may alternative be in the form of a protrusion extending into the barrel 20. In any event, the rifling can be used to align the projectiles 21 within the barrel 20, as well as to allow spin to be imparted to the projectiles as they are deployed, as will be appreciated by persons skilled in the art. However this is not essential to the operation of the invention.

Thus, it will be appreciated that this represents a practical configuration that can easily be integrated into existing missiles. However, this is not intended to be restrictive, but rather is only an example of the configurations that may be used.

It can be shown from simple geometry that the angle of separation A between lead projectiles (as measured from the missile axis) at deployment radius R, is given by:

$$A=2\sin^{-1}[1/(2P)]$$

where P=number of projectiles in the projectile line 31.

Thus, for four projectiles, this gives a separation angle of 14.36°. In this example, using twenty six barrels as outlined above, the angle between barrels 20 in a barrel array 30 is 360/26=13.85°, thereby allowing the four projectiles to cover the area defined by the deployment radius.

The actual size of the deployment radius R will depend on the desired maximum separation between the projectiles. Thus, for example, if there is a 1 m separation between projectiles in a projectiles line, then there will also be a 1 m separation between lead projectiles 21A in adjacent projectile lines at the deployment radius R which in turn will be 4 m. The projectiles therefore form a grid in which no two projectiles are separated by more than 1 m. If the enemy missile is assumed to be slightly larger than 1 m in diameter then the missile cannot pass through the deployment radius of one barrel-plane without a projectile interception occurring (and 1-3 further projectile interceptions being likely).

Assuming 29 barrel arrays mounted to the missile, with appropriate skewing between adjacent barrel arrays (providing a total of 3016 projectiles), the grid (in which no two projectiles are separated by more than the diameter of the enemy missile) can be deployed up to 7 deployment radii (which is a radius of 28 m, a diameter of 56 m and an area of 2462 $m^2$ assuming that the projectile separation is set to a maximum 1 m), as outlined above in table 1.

Figure 16A:
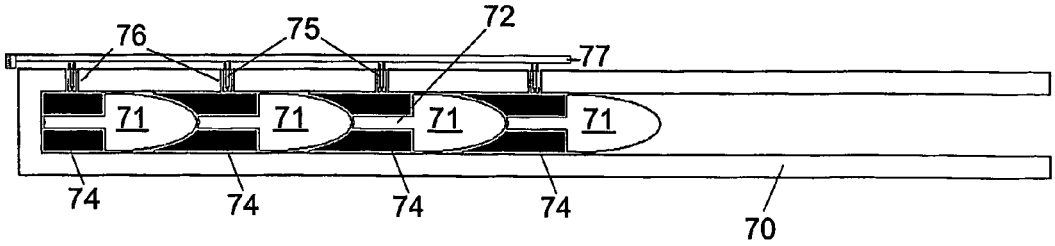
FIGS. 16A to 16F are schematic diagrams of alternative barrel, projectile and support system configurations.

An alternative configuration for assembly of the barrel array matrix 34 will now be described. In this example, the barrels are formed as individual units which are then attached to the central support cylinder 51. An example of a suitable barrel 70 is shown in FIG. 16A. In this example, the barrel 70 includes a number of projectiles 71 including a shaped tail portion 72, which defines a cavity including the associated propellant 74. The propellant is coupled to semi-conductor bridges (SCBs) 75 mounted in inlet ports 76 in the barrel 70 as shown. The SCBs are then coupled to a respective PCB assembly 77 as shown.

Thus, in this example, each barrel is constructed with all the connections required to couple the projectiles to the control electronics. This therefore requires that a respective PCB is provided for each barrel 20, or at least each barrel array 30, if these are formed concurrently.

The SCBs generally include a header and are threaded into position (or otherwise appropriately held in place) to hold against firing pressure. In this example, the SCBs are held in place by associated plugs, which are the same size as the inlet ports 76. However the SCB plugs could extend beyond the outer diameter of the barrel 70 for increased strength. The plugs are then connected to a plastic (or other suitable material) 'band' which is preferably hermetically sealed against the barrel wall and contains wiring for the four plugs which lead to a main plug at the rear of the barrel. The 'band' could be reinforced with a metal surround for increased strength if deemed required. The main plug has 5 'pins'—one four each of the four inlet port plugs containing the SCBs and one earth. The main plug is also preferably hermetically sealed once attached to firing control system, described in more detail below.

Figure 16B:
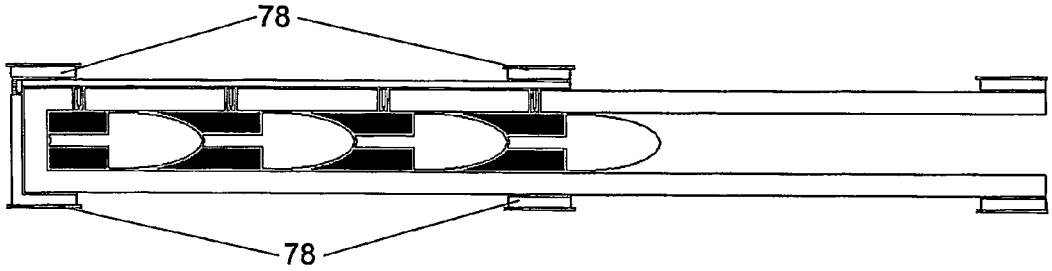

In order to protect the PCB assembly when the barrel 70 is being mounted to a central support cylinder 51, the barrel 70, and PCB may be mounted within a cylindrical housing or framework 78 as shown in FIG. 16B. The framework 78 may be formed from aluminium or a suitable composite material as will be appreciated by persons skilled in the art. The entire structure including the framework 78 can then be attached to the central support cylinder 51, to for a matrix similar to that described above.

Figure 16C:
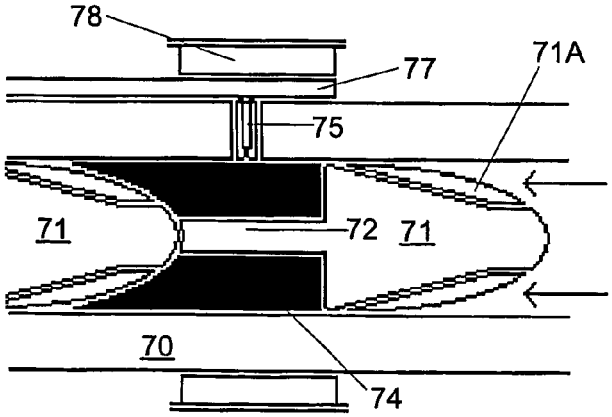

In this example, in order to ensure that the projectiles are locked in place within the barrel, thereby sealing against the barrel bore, the projectiles 71 may utilise a wedge portion 71A on the projectile nose as shown in FIG. 16C. In this case, when the propellant and projectiles are inserted into the barrel in the direction of arrows 73, the projectiles can be urged in towards the breach end of the barrel 70, thereby causing the wedge shaped portion to seal against the barrel bore. Similarly, when any particular projectile is fired the force from the associated propellant expansion further locks the next projectile in the stack against the barrel wall, thereby preventing the blow-by ignition of successive rounds in the stack.

However, in this example, the tail portion 72 must be of a relatively large thickness to provide necessary support during the deployment of the projectiles. Accordingly, an alternative configuration can be used as shown for example in FIG. 16D. In this example, projectiles 71 are tubular. This provides additional strength whilst utilising a smaller volume of material to thereby provide for an increased propellant volume in a projectile of the same length. The projectile 71 can include portions 79 in the form of holes or 'soft spots', which allow the ignition of the SCB to ignite the propellant by burning through this section upon ignition. If the portions 79 are simply to be holes, the propellant cavity of each projectile would be filled with propellant through the inlet ports once the projectiles have been loaded and locked into position in the barrel. The SCB and header plugs would then be threaded into position. If the portions 79 are 'soft spots' the projectiles would be filled with propellant before insertion into the barrel.

Figure 16D:
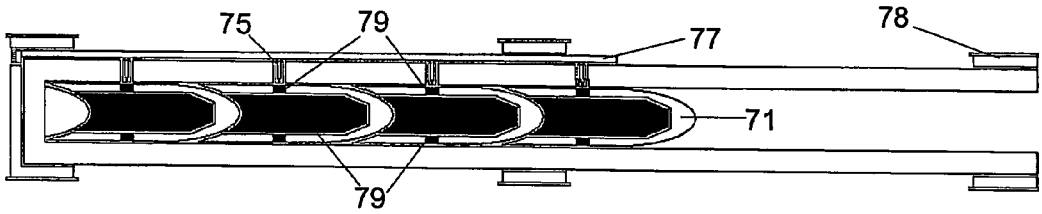
Figure 16E:
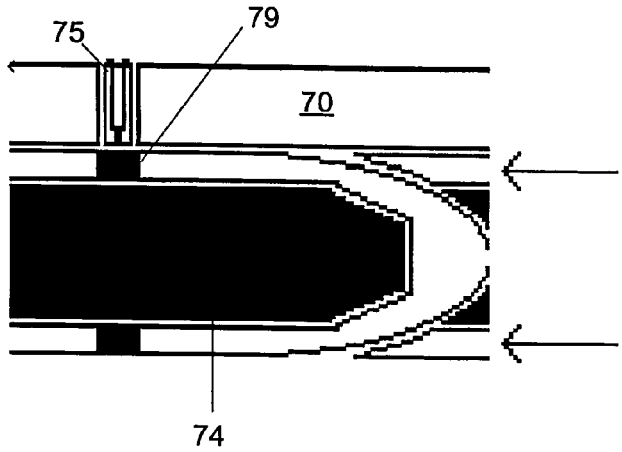

This type of projectile also utilises sealing against the barrel wall both in construction and as a result of the propellant expansion of the round in front to prevent the blow-by ignition of successive rounds in the stack, as shown in FIG. 16E.

Figure 16F:
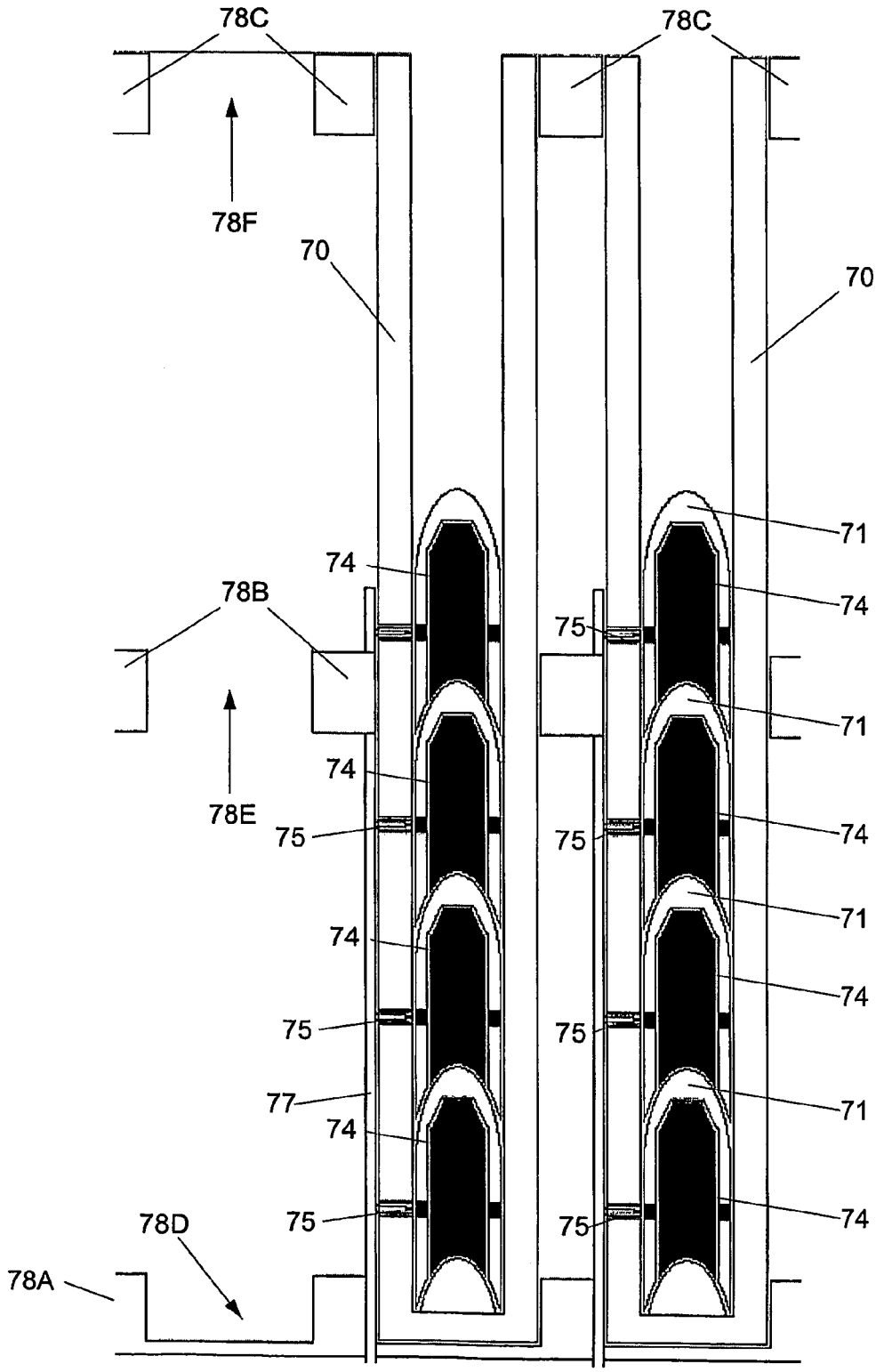

An example of the mounting of the barrels 20 of FIGS. 16D and 16E is shown in FIG. 16F, which is an end view of the matrix 34, with the cylindrical nature of the construction, and the relative angles between the barrels 70 not being shown for clarity. In any event, in this example, the framework 78 is formed from a central support cylinder 78A, equivalent to the central support cylinder 51 of the embodiment shown in FIG. 15, which therefore incorporates the control electronics. The framework 78 further includes an inner cylinder 78B and an outer cylinder 78C. In use, the cylinders are held in position by respective vertical supports (not shown).

The matrix is therefore constructed by first coupling the inner and outer cylinders 78B, 78C to the central support cylinder 78A using the appropriate vertical supports. A hole is then drilled through the outer and inner cylinders 78B, 78C, as shown at 78E, 78F, with the drilling being continued through into the central support cylinder 78A, to define a recess 78D. The barrels 70 can then be inserted into the respective holes, such that the barrels 70 are supported by the respective inner and outer cylinders 78B, 78C, with the breach end of the barrels 70 resting in the recess 78D created in the central support cylinder. Typically however, before the barrel is inserted, an additional hole is drilled though all of the central support cylinder 78A, and the inner and out cylinders 78B, 78C to incorporate the PCB 77. In particular, this is arranged such that the PCB extends through the central support cylinder 78A, allowing the PCB to be coupled to the control electronics, thereby allowing the barrels 70 to be inserted into the holes 78E, 78F, with the breach end in the recess 78D, and the PCB extending into the cavity within the central support cylinder 78A.

It will be appreciated by persons skilled in the art that this allows the framework to be constructed and the barrels 70 simply inserted therein. The barrels can be held in place using an appropriate retaining means depending on the application and the stress to which the matrix 34 will be subject. Thus for example, the barrels 70 may be held in place due to a tight fit between the breach end and the recess 78D, or alternatively may be held in place using glue, welding, screws or the like.

In any event, the insertion of the barrels also allows the PCBs 77 to be aligned with appropriate connectors provided on the control electronics, thereby ensuring that insertion of the barrels 70 into the framework 78 also automatically couples the barrel to the control electronics, thereby simplifying the process of producing the matrix 34.

The control electronics which form the firing system typically include a circuit adapted to generate pulses of electricity which are applied to the ignition means 18, 75. This can be achieved using a hard-wired ignition system constructed using either metal barrels to act as one of the required connections to the ignition means, or through use of barrels cast from reaction injection moulded (RIM) thermo-set PDCPD, with wires embedded therein. In either case, the ignition means are generally in the form of SCBs as described above.

In the above mentioned case, it is possible to provide a respective connection to each ignition means in each barrel within an array. Alternatively it is also possible to utilise a two-wire ignition system in which the mesh planes 52 and lateral supports 55 would be replaced with a single loop of wire spanning either side of each barrel in the entire system. Selective ignition would be based upon coded SCBs or through the utilisation of varying resistances for different ignition means 18. In this case, the firing system would be adapted to generate coded pulses, or pulses having different current magnitudes.

Figure 17:
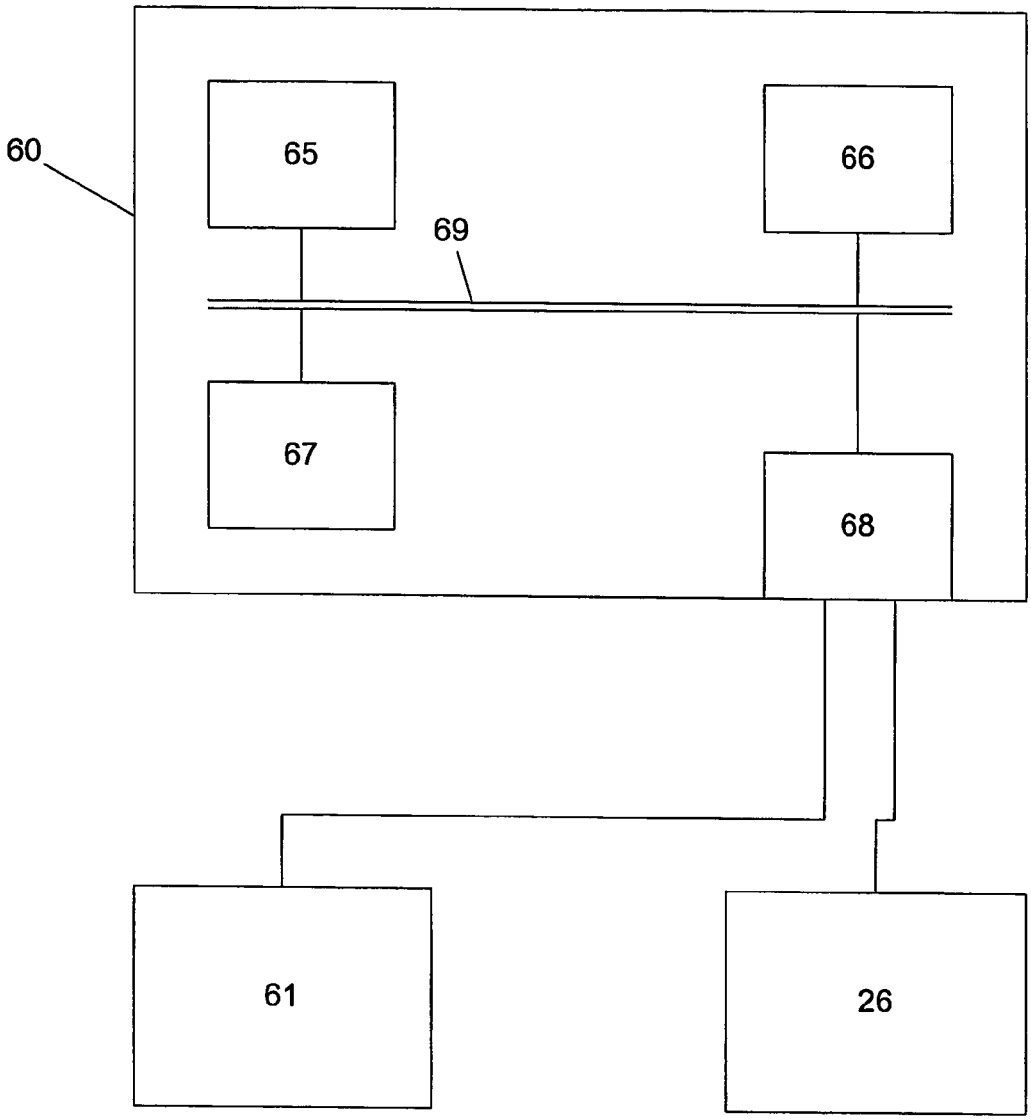
FIG. 17 is a schematic diagram of a control system for controlling the projectile deployment.

An example of the control systems will now be described in more detail with respect to FIG. 17. In particular, the control system will typically be formed from a processing system 60 coupled to a number of sensors 61, and the firing systems 26. In use the processing system will typically include a processor 65, coupled to a memory 66, an optional I/O device 67, and an external interface 68, via a bus 69.

In use, the sensors are used to provide signals representative of the position of the target missile relative to the kill vehicle 10. The processor 65 obtains signals from the sensors 61, and then uses these to select a projectile deployment pattern in accordance with pattern data stored in the memory 66. The processor 65 then generates suitable signals to thereby activate the firing systems 26, and deploy the projectiles as required. In this case, a respective firing system 26 may be provided for each barrel, or each barrel array 30. However, typically a single firing system will be provided for all the barrel arrays 30. For example, in the case of the barrel matrix 34 shown in FIGS. 15A-D, the firing circuit will typically consist of a circuit for generating a suitable electrical pulse for activating the ignition means, together with a switching system for selectively coupling the output of the firing circuit to respective ones of the mesh planes 56 and the lateral connectors 55, as required. In any case, the one or more firing systems 26 must be adapted to deploy the projectiles independently from each barrel 20 of each barrel array 30.

In any event, it will be appreciated from this that the control system can be implemented in a number of ways. For example, the control system can be adapted to receive signals from the sensors 61 mounted to the missiles 10.

Typically in this case the sensors 61 would include an array of sensory technology that can be used to detect the presence of the target missile, and optionally guide the kill vehicle 10 to intercept the target missile. As will be appreciated by persons skilled in the art, such technologies are often deemed classified, and as a result, detail is not provided in this document. However, examples of sensory technologies used in the detection of target missiles and the guidance of kill vehicles 10 include (but are not limited to):

EMR (electromagnetic radiation) reflection analysis sensors, such as radar, X-ray or infra-red sensors Particle reflection analysis sensors In any event, the sensors are typically mounted to the front of the kill vehicle to detect targets in front of the kill vehicle.

However, remote sensing may also be used, in which case, the sensors may be in the form of satellites, adapted to sense the position of both the kill vehicle 10 and the target missile 32. In this case, an indication of the respective missile positions can be transferred to the processing system 60 via an appropriate wireless communications system, as will be appreciated by persons skilled in the art.

Alternatively, the processing system 60 may be positioned remotely to the missile. For example the processing system 60 may be located in a satellite, in a ground based base station, such as a command centre or the like. The processing system 60 would be adapted to activate the firing system 26 via an appropriate wireless communications system.

In either case, the processing system 60 will be adapted to determine the relative positions of the missiles and then access pattern data stored in the memory 66. This may be in the form of a Look-Up Table (LUT), which specifies the optimum projectile deployment pattern that should be used to maximise the chances of destroying the target missile.

In particular, the LUT will specify from which barrels 20 and which barrel arrays 30 projectiles are to be deployed for different sizes and intercept courses for the target missile 32. It will be appreciated that this may be in the form of commands for controlling the switching to thereby control the connection between a firing circuit and selected ones of the mesh planes 56 and lateral connectors 55.

Thus, in general, the processor 65 will determine the likely velocity of the target missile at interception and then taking into account the type of missile, select an appropriate projectile deployment pattern. For example, the cross sectional area of the target missile will be used to determine the maximum separation distance X between projectiles, and hence the deployment radius R and the associated rate of deployment of the projectiles. Similarly, the relative positioning and velocity of the target missile will result in modification of the projectile positioning.

The processing system 60 will then determine the time at which the interception is to occur, and time the deployment of the projectiles 21 accordingly.

It will also be appreciated from the above that the processing system 60 may form part of the flight control system 14 adapted to control the missile trajectory.

Figure 18A:
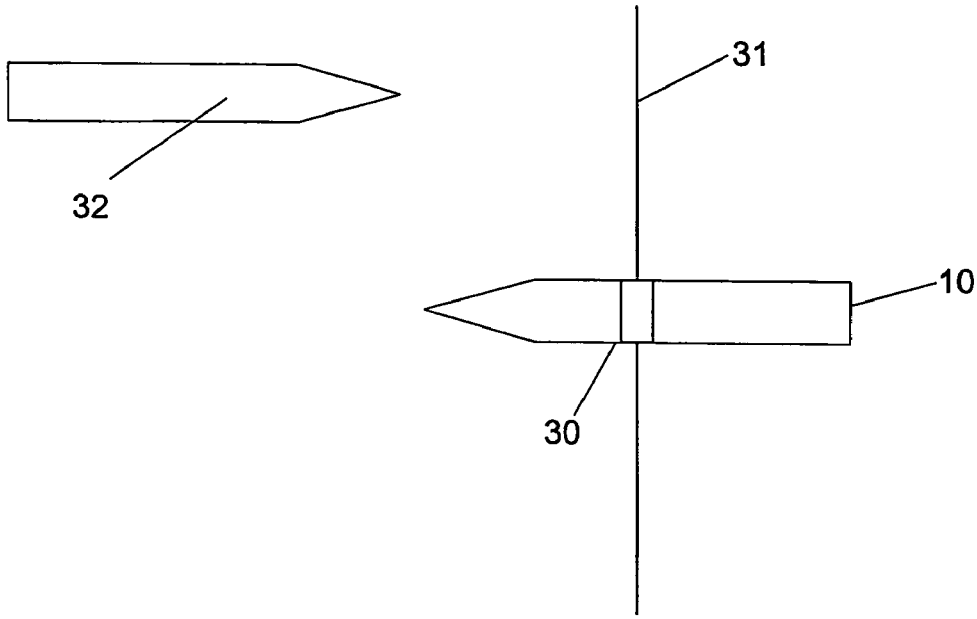
FIGS. 18A to 18C are schematic plan views of the relative angle of approach between the missile of FIG. 2 and a target missile.
Figure 18B:
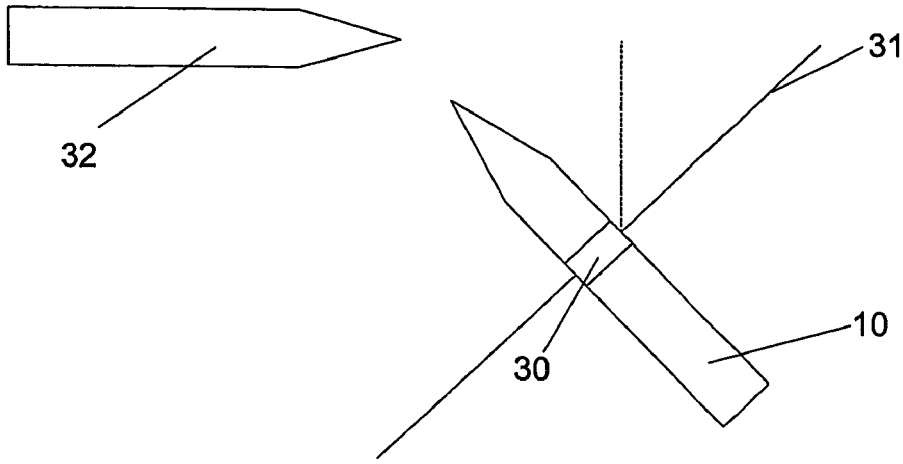
Figure 18C:
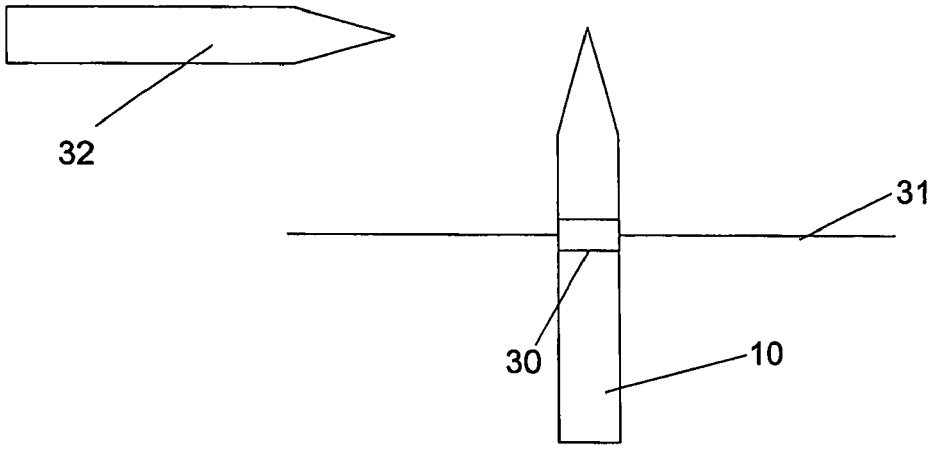

Some examples will now be described with respect to FIGS. 18A to 18C which show that the optimum angle of approach is 0-degrees (or 180-degrees relative to one another) because the effective width of the projectile field is maximised, as shown in FIG. 18A. An approach angle of 90-degrees the advantages of the missile system are largely lost. At acute angles of approach, as depicted in FIG. 18B, the extent of coverage of the projectile lines 31 are geometrically reduced to a smaller effective size, as shown in the dotted line in FIG. 18B, thereby reducing the effectiveness of the system.

Thus, it will be appreciated that if the missiles are approaching with a less than optimum angle, the processing system 60 will select the largest size projectile deployment pattern (ie. the one extending to the largest number of deployment radii) available to thereby maximise a chance of the target missile being successfully intercepted. However, if the missile is approaching at a more optimum angle, the processing system 60 may reduce the number of deployment radii to which the projectiles will extend with the required separation distance to thereby maximise the number of hits against the missile that will be achieved.

Thus, there may be situations however, in which the grid is not required to be deployed to the maximum radius. In these situations the grid can be deployed to a smaller number of deployment radii, ensuring multiple projectile interceptions within the chosen radius.

For example, with 29 projectile arrays 30, table 1 indicates that if the grid is only deployed to 3 deployment radii, 7 barrel planes would be required with 22 left over. The left over barrel-planes can be used to blanket the required radius with multiple sets of grids (in which no 2 projectiles are separated by more than the diameter of the enemy missile).

It can be seen from the above table that at 3 deployment radii, 4 sets of grids can be deployed (thus ensuring at least 4 projectile interceptions with 1-12 further projectile interceptions being likely) with 1 barrel-plane left over. This relationship is summarised in the table 2 below:

TABLE 2

| Distance covered in deployment radii R | Number of expected projectile interceptions. ie. the number of complete projectile-grids covering the radius | Distance between lines/projectiles in enemy missile diameters | Number of likely further projectile interceptions |
|---|---|---|---|
| 1 | 29 | 1/29 | 1-87 |
| 2 | 9 | 1/9 | 1-27 |
| 3 | 4 | 1/4 | 1-12 |
| 4 | 2(.6) | 1/2 | 1-6 |
| 5 | 1(.8) | 1 | 1-3 |

In the case, each barrel array would be skewed by 13.85/29=0.48 degrees as to one another (in a 'twisting' fashion from top to bottom). This means that (for example) if the grid (using all of the 29 barrel-planes available) is only deployed to one deployment radius, the distance between any two projectile lines in the grid is no more than 1/29 enemy missile diameter.

Similarly in this scenario, firing could be timed such that the projectiles in each line from any particular barrel-plane would be fired 1/29 of an enemy missile diameter later' than each adjacent barrel-plane, in sequential fashion. This means that if enemy missile diameter is set to 1 m (deployment radius therefore being 4 m), any object larger than 3.4 cm diameter cannot pass through the grid without intercepting at least 29 projectiles (with 1-87 further projectile interceptions being likely).

The barrel-plane cylinder could also deploy projectiles in a 'ring' shape such that at 7 deployment radii (7×4 m) for example, the distance between projectiles is only 25 cm.

The ring would have a depth of 4 enemy missile diameters and could be deployed up to 28 deployment radii and maintain a grid in which no 2 projectiles are separated by more than enemy missile diameter.

This relationship is summarised in table 3 below.

TABLE 3

| Distance ring is deployed to in deployment radii | Number of expected projectile interceptions | Distance between lines in enemy missile diameters | Number of likely further projectile interceptions |
|---|---|---|---|
| 1 | 29 | 1/29 | 1-87 |
| 2 | 14 | 1/14 | 1-42 |
| 3 | 9 | 1/9 | 1-27 |
| 4 | 7 | 1/7 | 1-21 |
| 5 | 5(.8) | 1/5 | 1-15 |
| 6 | 4(.8) | 1/4 | 1-12 |
| 7 | 4 | 1/4 | 1-12 |
| 8 | 3(.6) | 1/3 | 1-9 |
| 9 | 3(.2) | 1/3 | 1-9 |
| 10 | 2(.9) | 1/2 | 1-6 |
| 11 | 2(.6) | 1/2 | 1-6 |
| 12 | 2(.4) | 1/2 | 1-6 |

It will therefore be appreciated that the control system can select a respective one of the firing patterns outlined above, as well as variations thereon, in order to maximise the chance of successfully disabling the target missile, and any deployed sub-munitions.

When controlling the projectile deployment pattern for a missile system such as that described above, it is also useful to take into account a number of additional factors, such as:

Recoil: The system is designed so as each barrel has a parallel and aligned barrel facing in the opposite direction. If both barrels fire simultaneously recoil forces will cancel out and there will be no resultant change in the trajectory of the kill vehicle.

Muzzle velocity: The muzzle velocity can be tailored to meet specific requirements by varying the propellant load carried within each projectile.

Dispersion: The projectiles will tend to naturally disperse due to small natural variations in trajectory.

In the configuration described above, the total weight of the support system, barrels and projectiles is under 50 kg, thereby allowing the assembly to be mounted to existing missiles/kill vehicles.

It will be appreciated by persons skilled in the art that a number of different barrel arrays can be used. Thus, for example, a barrel array could be used to deploy projectiles in front of the kill vehicle 10, in which case the operation of the control system is adapted accordingly. Such a configuration is useful for destroying sub-munitions (decoys/balloons) ejected in front of the main target missile, as well as in for providing additional opportunity for a successful hit on the missile itself, as described above with respect to FIGS. 14A to 14E.

An example configuration will now be described. For example, assuming the muzzle velocity of the .22 cal projectiles is 300 m/s and the velocity of the enemy missile relative to the kill vehicle 10 is 7,000 m/s. This provides a closing velocity of 7,300 m/s. Now, in order that the missile has ten seconds (example time period) to manoeuvre after projectile impact, the projectile grid must be fired when the kill vehicle 10 is 7.3×10=73 km from the enemy missile. Using this distance, we can calculate what angle between the forward-facing barrels provides an appropriate projectile pattern at this distance. In this example, the separation angle A between projectiles is given by:—

$$\tan(A)=1/7300.$$

$$A=\tan-1(1/7300)=0.0078 \text{ degrees.}$$

Figure 19:
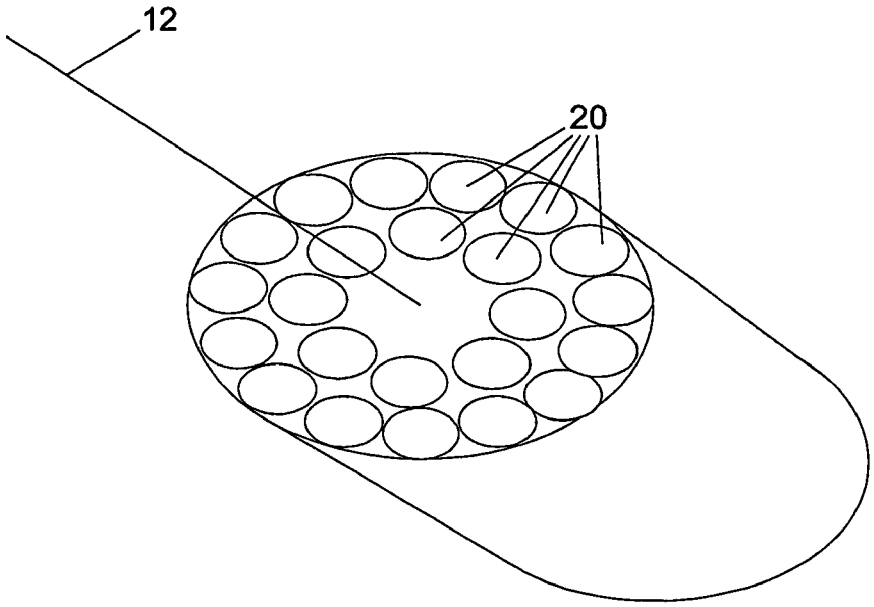
FIG. 19 is a schematic diagram of a third example of a barrel array.

It will be taken throughout this document that such an angle is negligible when considering the design aspects of the system, and accordingly, it can assumed that the barrel array is a cylinder, with circumferentially spaced barrels extending parallel to the missile body axis 12, as shown in FIG. 19. Assuming a volume of 32.3 cm in diameter and 31 cm in depth, to allow the barrel array to be mounted in a standard missile, it is possible to determine the total number of projectiles that can be provided.

In particular, a cuboid of these dimensions could include 30 barrels with 31, 0.5 cm spacings in between and on either edge takes up (30×0.56)+(31×0.5)=32.3 cm. This gives us a total of 30×30=900 barrels. The area of the leading face of the cuboid=32.3×32.3=1043 cm2. The area of a circle of this diameter is (pi)(16.15)2=819 cm2. Thus proportionally, the cylinder would comprise (819/1043)×900=707 barrels.

A central support cylinder 51 is generally provided to house the processing system 60 and other appropriate electronics. A cuboid of these dimensions would house approx 5×5=25 barrels. The area a square of these dimensions is 25 $cm^2$ and a circle of these dimensions 20 $cm^2$. Subtracting 20 barrels from the previous total of 707 to come to the end result of approximately 687 barrels. Subtracting 5 cm of free bore and 2 cm of space at the base of the barrels there is 24 cm of barrel left to hold projectiles—12 projectiles per barrel. There are thus 687×12=8244 projectiles in the barrel array.

Upon first impact the projectile grid would be 30 m in diameter with a 1 m separation between lead projectiles. The natural inherent dispersion between projectiles from the same barrel would reduce this distance to a statistically appropriate average.

The configuration can be built using a grid system of radial, circular and lateral connectors, similar to that shown in FIGS. 15A and 15B. In this case, the barrels are inserted in a direction parallel to the support body axis. Accordingly, in this case, circular connectors, would be electrically coupled to lateral connectors to define cylindrical mesh planes. The barrels 20 would intersect the circular connectors to allow a mesh plane to be connected to each of a group of circumferentially spaced barrels 20 at a respective radial position. A number of mesh planes having respective radii would be provided to allow all the barrels to be coupled to a mesh plane. Radial connectors, which are electrically isolated from the mesh planes, would then be coupled to respective projectiles 21 in the barrels. In a manner similar to that described above, this allow control electronics to be independently coupled to each projectile in the array, allowing the respective projectiles to be deployed independently, as will be appreciated by persons skilled in the art. Thus, this allows a matrix to be formed by drilling appropriate barrels in a direction parallel to the body axis.

Again, the total weight of such a system will be under 50 kg.

Alternatively, the barrel array 40 may be formed by mounting barrels, such as the barrels shown in FIG. 16 to a central support of some form. Again, the exact form of this will depend on the relative orientations of the barrels 20 within the array 40, but will typically include using a number of substantially planar support planes, aligned substantially perpendicularly to the body axis 12. Holes can then be drilled through the support planes in a direction substantially parallel to the body axis 12, thereby allowing the barrels to be inserted therein.

In this example, it will be appreciated that if the barrel are similar to the barrels 70, then the barrels may include a PCB 77 which is adapted to connect the barrel to the control electronics. The manner in which this is achieved will depend on the implementation. Fr example, the barrel array may use a substantially planar support into which the breach ends of the barrels are provided, with the control electronics being housed in an appropriate cavity on the underside of the planar support. In this case, the PCBs can then be adapted to be inserted through suitable holes in the planar support, to interface directly with appropriate connectors on the control electronics.

Alternatively, for example, the control electronics can be housed in a central support cylinder, provided along the body axis. In this case, the barrels are circumferentially spaced around the central support cylinder, and it is therefore necessary to connect the PCBs 77 to the control electronics using additional connections. This, may be achieved for example by having appropriate connections, such as a purpose built PCB extending along the planar supports, to the control electronics in the central support cylinder, as will be appreciated by persons skilled in the art.

Figure 20A:
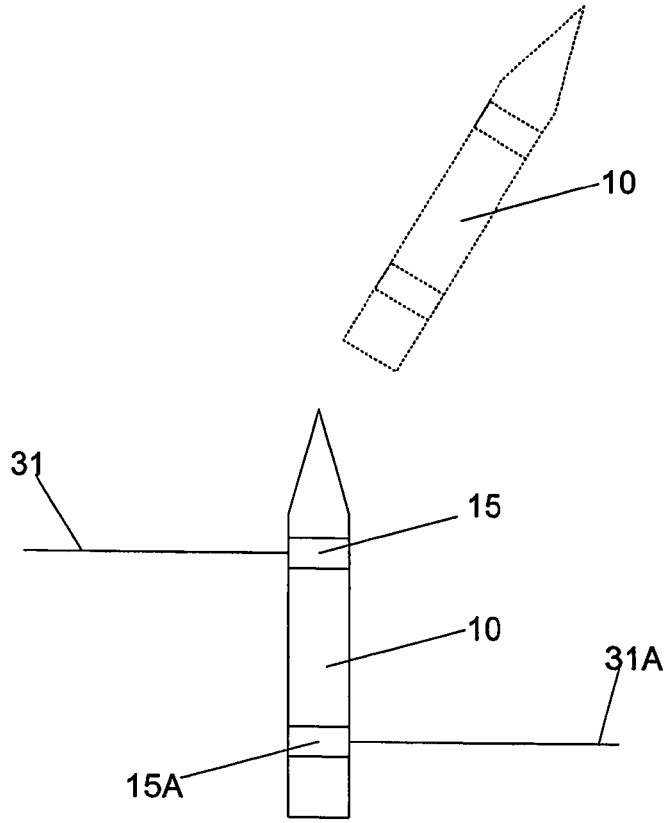
FIGS. 20A and 20B are a schematic diagram of an example of the use of barrel arrays to modify a missile trajectory.
Figure 20B:
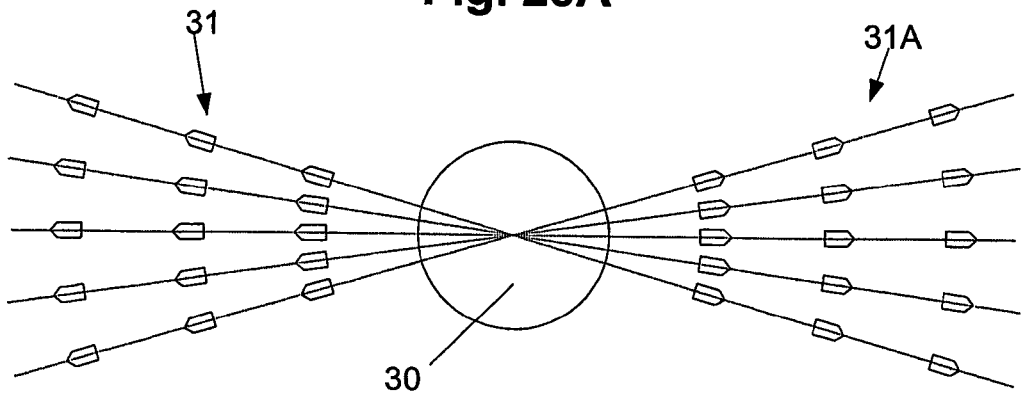

A further example of use of the barrel arrays will now be described with respect to FIGS. 20A and 20B. In particular, in this example, the projectiles are deployed in a non symmetrical fashion, to thereby function as a divert propulsion system to effect changes to the trajectory of the kill vehicle 10. Thus, for example, deploying projectiles along the projectile lines 31 will impart a lateral momentum to the kill vehicle. Assuming the kill vehicle has an existing forward momentum, then the position of the missile following this manoeuvre will be as shown in the dotted lines.

In this example, the kill vehicle includes a set of barrel arrays 15A in the tail portion of the kill vehicle in order to allow additional modification of the kill vehicle's momentum, as will be appreciated by persons skilled in the art.

In general, the firing of a single line of projectiles 31 from the barrel array 30, and another line of projectiles 31A from the barrel array 30A, will only impart a minimal momentum change on the kill vehicle, and accordingly, it is typical for a number of projectile lines 31, 31A to be deployed, to thereby increase the change in momentum on the kill vehicle 10, as will be appreciated by persons skilled in the art.

It will therefore be appreciated that a wide range of configurations can be used, and that any number of barrel arrays of different designs may be incorporated into a missile in a manner similar to that described above. Appropriate control of the projectile deployment by the processing system 60 can then be used to deploy the projectiles in a predetermined pattern, thereby increasing the likelihood of disabling a target missile.

It will be appreciated that the kill vehicle 10 can also be used to intercept other targets, including both static and moving targets. In this case, the projectile deployment pattern can be adapted depending on the respective target. Thus, for example, the deployment pattern may be spread out over a wide area, or concentrated, to thereby maximise damage to a target, or to allow multiple targets to be hit simultaneously, using a single kill vehicle 10.

It will also be appreciated that the barrel arrays could be mounted to vehicles other than kill vehicles, depending on the circumstances in which they are to be used. Thus, for example, the barrel arrays could be mounted directly to missiles, or the like. The use of the term kill vehicle throughout the specification is therefore by way of example only, and it will be appreciated that the projectile deployment system could be mounted to and implemented on any device. Thus, the projectile deployment system may be integrated into any target intercept device.

Preferably the target intercept device is however propelled, with the device being propelled primarily in a forward direction substantially parallel to the body axis, as will be appreciated by persons skilled in the art, and as described above, although this is not essential.

It will be noted that the target missile will impact on the projectiles with a relative velocity of up to and beyond Mach 23. In this case, deployment of a homogenous, grid-like field of projectiles, in which all projectiles are separated by slightly less than the cross-sectional diameter of the target missile, ensures that the target missile will impact on at least some of the projectiles in the field.

Persons skilled in the art will appreciate that numerous variations and modifications will become apparent. All such variations and modifications which become apparent to persons skilled in the art, should be considered to fall within the spirit and scope that the invention broadly appearing before described.

The invention claimed is:

1. Apparatus for intercepting a target, the apparatus including:

a) a projectile deployment system having:
  i) a body; and,
  ii) a number of projectile systems mounted to the body in an array, each projectile system being adapted to deploy a number of projectiles in a predetermined direction with respect to the body and, including:
    (1) a barrel,
    (2) a number of projectiles, and
    (3) a number of charges, each charge being adapted to urge a respective projectile along the barrel to thereby deploy the projectile; and b) a controller, the controller being adapted to selectively activate one or more of the projectile systems to thereby deploy projectiles in accordance with a projectile deployment pattern, wherein the controller includes one or more sensors for sensing the target, and
  a processor adapted to
    monitor the sensors to thereby determine the position of the target with respect to the projectile deployment system,
    determine a projectile deployment pattern,
    select one or more of the projectile systems in accordance with the projectile deployment pattern, and
    activate the selected projectile systems.

2. Apparatus according to claim 1, further including:

a) a vehicle having a vehicle body defining a vehicle axis;
b) a propellant system for propelling the vehicle; and
c) a flight controller, the flight controller being adapted to control the propellant system to thereby control the vehicle trajectory.

3. Apparatus according to claim 1, further including a projectile deployment system, the projectile deployment system including:

a) a body defining a body axis;
b) a barrel array formed from a number of barrels circumferentially spaced around the body axis, each barrel being arranged at a predetermined angle with respect to the body axis;
c) a number of projectiles axially stacked along each barrel; and d) a number of charges, each charge being associated with a respective projectile to urge the respective projectile along the barrel upon activation to thereby deploy the projectile.

4. Apparatus according to claim 3, wherein the projectile deployment system is aligned such that the vehicle axis is substantially coaxial with the body axis.

5. Apparatus according to claim 3, wherein deployment of each projectile causes a reactive force along the respective barrel, the pattern of projectiles being at least one of:

a) symmetric around the body axis to thereby equalise the reactive forces on the body; and b) non-symmetric around the body axis to thereby generate non-symmetric reactive forces, thereby causing deflection of the body.

6. Apparatus according to claim 5, wherein a firing pattern of the projectiles is adapted to control the trajectory of the vehicle.

7. Apparatus according to claim 3, wherein at least some of the barrels extend radially outwardly from the body axis.

8. Apparatus according to claim 3, wherein at least some of the barrels define a barrel array, the barrel away being rotatably mounted to the body to thereby rotate about the body axis.

9. Apparatus according to claim 3, wherein at least some of the barrels extend in a direction parallel to the body axis.

10. Apparatus according to claim 1, wherein the target is a missile.

11. Apparatus according to claim 1, wherein the projectile deployment pattern is selected to thereby increase the effective cross sectional area of the vehicle.

12. Apparatus according to claim 1, wherein the controller includes a store for storing pattern data representing a number of different projectile deployment patterns, the processor being adapted to select one of the stored projectile deployment patterns in accordance with the position of the target.

13. Apparatus according to claim 12, wherein the pattern data indicates at least one of:

a) the barrels from which projectiles should be fired; and b) the rate of deployment of the projectiles.

14. Apparatus according to claim 1, wherein the vehicle is at least one of a kill vehicle and a missile.

15. An apparatus according to claim 1, wherein the controller determines the projectile deployment pattern using a lookup table.

16. Apparatus according to claim 1, wherein the body includes a cavity for receiving the controller.

17. Apparatus according to claim 1, wherein the one or more sensors are located remotely from the body and the controller is coupled to the one or more sensors via a communications system.

18. Apparatus according to claim 1, wherein at least some of the barrels define a barrel away for deploying projectiles in directions along and outwardly from the body axis.

19. A missile for intercepting a target, the missile including:

a) a missile body defining a missile axis; and b) apparatus including:

a projectile deployment system having:

i) a body; and ii) a number of projectile systems mounted to the body in an array, each projectile system being adapted to deploy a number of projectiles in a predetermined direction with respect to the body and, including:

(1) a barrel, (2) a number of projectiles, and (3) a number of charges, each charge being adapted to urge a respective projectile along the barrel to thereby deploy the projectile;

a controller, the controller being adapted to selectively activate one or more of the projectile systems to thereby deploy projectiles in accordance with a projectile deployment pattern, wherein the controller includes one or more sensors for sensing the target, and a processor adapted to monitor the sensors to thereby determine the position of the target with respect to the missile, determine a projectile deployment pattern, select one or more of the projectile systems in accordance with the projectile deployment pattern, and activate the selected projectile systems.

* * * * *